US006218762B1

(12) United States Patent
Hill et al.

(10) Patent No.: US 6,218,762 B1
(45) **Date of Patent: *Apr. 17, 2001**

(54) MULTI-DIMENSIONAL SCALABLE DISPLACEMENT ENABLED MICROELECTROMECHANICAL ACTUATOR STRUCTURES AND ARRAYS

(75) Inventors: Edward A. Hill, Chapel Hill; Vijayakumar R. Dhuler, Raleigh, both of NC (US)

(73) Assignee: MCNC, Research Triangle Park, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/303,996

(22) Filed: May 3, 1999

(51) Int. Cl.[7] ..... H01H 61/00

(52) U.S. Cl. ..... 310/307; 257/415

(58) Field of Search ..... 310/306, 307; 257/415, 462; 251/11

(56) References Cited

U.S. PATENT DOCUMENTS

| | | | |
|---|---|---|---|
| 1,258,368 | 3/1918 | Smith | 310/307 |
| 1,658,669 | 2/1928 | Cohn et al. | 310/307 |
| 3,213,318 | 10/1965 | Glenn | 310/307 |

(List continued on next page.)

FOREIGN PATENT DOCUMENTS

| | | | |
|---|---|---|---|
| 38 09 597 | 10/1989 | (DE) | G05D/3/00 |
| 0 469 749 | 2/1992 | (EP) | F16K/7/14 |
| 0 478 956 | 4/1992 | (EP) | H01H/4/00 |

(List continued on next page.)

OTHER PUBLICATIONS

International Search Report, PCT/US00/09130, Jul. 28, 2000.

(List continued on next page.)

*Primary Examiner*—Thomas M. Dougherty
(74) *Attorney, Agent, or Firm*—Myers Bigel Sibley & Sajovec

(57) ABSTRACT

Microelectromechanical system (MEMS) structures and arrays that provide movement in one, two, and/or three dimensions in response to selective thermal actuation. Significant amounts of scalable displacement are provided. In one embodiment, pairs of thermal arched beams are operably interconnected and thermally actuated to create structures and arrays capable of moving in a plane parallel to the underlying substrate in one and/or two dimensions. One embodiment provides an arched beam operably connected to a crossbeam such that the medial portion arches and alters its separation from the crossbeam when thermally actuated. In another embodiment, at least one thermal arched beam is arched in a nonparallel direction with respect to the plane defined by the underlying substrate. In response to thermal actuation, the medial portion of the arched beam is arched to a greater degree than the end portions of the thermal arched beam, thereby altering the separation of the medial portion from the underlying substrate. One embodiment combines first and second thermal arched beams having medial portions arched in opposed nonparallel directions with respect to the plane defined by the underlying substrate by even greater amounts. In response to thermal actuation, the medial portions thereof arch in opposite nonparallel directions with respect to the underlying substrate, thereby altering the separation of the medial portions from the underlying substrate. Hybrid thermally actuated structures are provided that combine arrays capable of moving in-plane and out of plane, such that motion in all three dimensions may be achieved in response to selective thermal actuation.

48 Claims, 21 Drawing Sheets

U.S. PATENT DOCUMENTS

| | | | | |
|---|---|---|---|---|
| 3,609,593 | | 9/1971 | Bell et al. | 310/307 |
| 3,630,020 | * | 12/1971 | Chase et al. | 60/23 |
| 4,806,815 | | 2/1989 | Honna | 310/307 |
| 5,179,499 | | 1/1993 | MacDonald et al. | 361/313 |
| 5,184,269 | | 2/1993 | Shimada et al. | 73/4 R |
| 5,206,557 | | 4/1993 | Bobbio | 310/309 |
| 5,261,747 | | 11/1993 | Deacutis et al. | 374/137 |
| 5,290,400 | | 3/1994 | Bobbio | 156/655 |
| 5,309,056 | | 5/1994 | Culp | 310/306 |
| 5,355,712 | | 10/1994 | Peterson et al. | 374/137 |
| 5,367,584 | | 11/1994 | Ghezzo et al. | 385/17 |
| 5,434,464 | | 7/1995 | Bobbio et al. | 310/309 |
| 5,441,343 | | 8/1995 | Pylkki et al. | 324/762 |
| 5,467,068 | | 11/1995 | Field et al. | 335/4 |
| 5,475,318 | | 12/1995 | Marcus et al. | 324/262 |
| 5,479,061 | | 12/1995 | Bobbio et al. | 310/309 |
| 5,483,799 | | 1/1996 | Dalto | 62/3.7 |
| 5,536,988 | | 7/1996 | Zhang et al. | 310/309 |
| 5,558,304 | | 9/1996 | Adams | 244/134 |
| 5,600,174 | | 2/1997 | Reay et al. | 257/467 |
| 5,602,955 | | 2/1997 | Haake | 385/136 |
| 5,606,635 | | 2/1997 | Haake | 385/53 |
| 5,629,665 | | 5/1997 | Kaufmann et al. | 337/38 |
| 5,644,177 | | 7/1997 | Guckel et al. | 310/40 MM |
| 5,659,285 | | 8/1997 | Takeda | 338/18 |
| 5,722,989 | | 3/1998 | Fitch et al. | 606/205 |
| 5,796,152 | * | 8/1998 | Carr et al. | 257/415 |
| 5,813,441 | | 9/1998 | Dewispelaere | 359/871 |
| 5,862,003 | | 1/1999 | Saif et al. | 359/871 |
| 5,881,198 | | 3/1999 | Haake | 385/136 |

FOREIGN PATENT DOCUMENTS

| | | | | |
|---|---|---|---|---|
| 0 665 590 | | 8/1995 | (EP) | H01L/23/00 |
| 764821 | | 5/1934 | (FR) . | |
| 792145 | | 3/1958 | (GB) . | |
| 7-234242 | * | 9/1995 | (JP) | 310/307 |
| WO 99/16096 | | 4/1999 | (WO) | H01H/61/00 |

OTHER PUBLICATIONS

*The Development of Cascadable Microdrives With Muscle–Like Operating Behaviour*, T. Frank et al., IOP Publishing Ltd., pp. 222–229, Feb. 1998.

Klaassen E H et al: "Silicon Fusion Bonding and Deep Reactive Ion Etching: A New Technology for Microstructures" *Sensors and Actuators A*, vol. 52, No. 1/03, Mar. 1996, pp. 132–139.

Phipps, Thesis: *Design And Development Of Microswitches For Micro–Electro–Mechanical Relay Matrices*, Air Force Inst. of Tech., Wright–Patterson AFB, OH School of Engineering, Dec. 1995.

Yamagata, et al., *A Micro Mobile Mechanism Using Thermal Expansion And Its Theoretical Analysis—A Comparison With Impact Drive Mechanism Using Piezoelectric Elements*, Proceedings of the IEEE Micro Electro Mechanica Systems, Dec. 1994, pp. 142–147.

Oh, et al., Thin Film Heater On A Thermally Isolated Microstructure, *Smart Materials Fabrication and Materials for Micro–Electro–Mechanical Systems*, Dec. 1992, pp. 277–282.

Safranek, *The Properties Of Electrodeposited Metals & Alloys*, *Amer. Electroplaters & Surface Finishers Society*, 1986, pp. 295–315.

Klassen, et al., *Silicon Fusion Bonding And Deep Reactive Ion Etching*; A New Technology For Microstructures, *Transducers '95—Eurosensors IX*, The 8th International Conference On Solid State Sensors And Actuators, and Eurosensors IX, Stockholm, Sweden, Jun. 25–29, 1995, pp. 556–559.

Noworolski, et al., *Fabrication Of SOI Wafers With Buried Cavities Using Silicon Fusion Bondng And Electrochemical Etchback*, *Transducers '95 —Eurosensors IX*, The 8th International Conference On Solid State Sensors And Actuators, and Eurosensors IX, Stockholm, Sweden, Jun. 25–29, 19995, pp. 71–74.

*Single Crystal Silicon Actuators And Sensors Based On Silicon Fusion Bonding Technology*, *Semiannual Progress Report 1, Advanced Research Projects Agency, Lucas NovaSensor*, Contract Number DAAL 01–94–C–3411, Apr.–Jul. 1994.

*Single Crystal Silicon Actuators And Sensors Based On Silicon Fusion Bonding Technology*, *Semiannual Progress Report 2, Advanced Research Projects Agency, Lucas NovaSensor*, Contract Number DAAL 01–94–C–3411, Jul. 1994–Jan. 1995.

*Single Crystal Silicon Actuators And Sensors Based On Silicon Fusion Bonding Technology*, *Semiannual Progress Report, Advanced Research Projects Agency, Lucas NovaSensor*, Contract Number DAAL 01–94–C–3411, Jan.–Jul. 1995.

*Single Crystal Silicon Actuators And Sensors Based On Silicon Fusion Bonding Technology*, *Semiannual Progress Report, Advanced Research Projects Agency, Lucas NovaSensor*, Contract Number DAAL 01–94–C–3411, Jan.–Aug. 1996.

J.W. Judy et al., *Surface Micromachined Linear Thermal Microactuator*, *International Electron Devices Meeting 1990. Technical Digest (CAT. No. 90CH2865–4*, Dec. 1990, New York, New York, pp. 629–632.

Fedder et al., *Multimode Digital Control of a Suspended Polysilicon Microstructure*, *Journal of Microelectromechanical System*, Dec. 1986, vol. 5, No. 4, pp. 283–297.

Comtois et al., *Applications for Surface–Micromachined Polysilicon Thermal Actuators and Arrays*, *Sensors and Actuators*, Jan. 1997, vol. 58, No. 1, pp. 19–25.

Lin et al., *Vertically Drives Microactuators by Electrothermal Buckling Effects*, *Sensors and Actuators*, Nov. 1998, vol. 17, Nos. 1–2, pp. 35–39.

* cited by examiner

Single Beam Actuator

Multiple Beam Actuator

Conducting Beams

Thermal Bottleneck
123
125
Cooling Surface

10

MULTI-DIMENSIONAL SCALABLE DISPLACEMENT ENABLED MICROELECTROMECHANICAL ACTUATOR STRUCTURES AND ARRAYS

FIELD OF THE INVENTION

The present invention relates to microelectromechanical actuator structures, and more particularly to thermally actuated microelectromechanical actuator structures and arrays capable of scalable displacement in multiple dimensions.

BACKGROUND OF THE INVENTION

Microelectromechanical structures (MEMS) and other microengineered devices are presently being developed for a wide variety of applications in view of the size, cost and reliability advantages provided by these devices. Many different varieties of MEMS devices have been created, including microgears, micromotors, and other micromachined devices that are capable of motion or applying force. These MEMS devices can be employed in a variety of applications including hydraulic applications in which MEMS pumps or valves are utilized and optical applications which include MEMS light valves and shutters.

MEMS devices have relied upon various techniques to provide the force necessary to cause the desired motion within these microstructures. MEMS devices are driven by electromagnetic fields, while other micromachined structures are activated by piezoelectric or electrostatic forces. Recently, MEMS devices that are actuated by the controlled thermal expansion of an actuator or other MEMS component have been developed. For example, U.S. patent application Ser. Nos. 08/767,192; 08/936,598, and 08/965,277 which are assigned to the assignee of the present invention, describe various types of thermally actuated MEMS devices. The contents of each of these applications are hereby incorporated by reference herein. Thermal arched beam (TAB) actuators as described in these applications comprise arched beams formed from silicon or metallic materials that further arch or otherwise deflect when heated, thereby creating motive force. These applications also describe various types of direct and indirect heating mechanisms for heating the beams to cause further arching. The aforementioned thermal actuators are designed to move in one direction, i.e., in one dimension. Further, arrays of thermal actuators are typically used to increase the amount of actuation force provided. While these thermally actuated MEMS devices may be used in a variety of MEMS applications, such as MEMS relays, valves and the like, some applications for MEMS thermal actuators require other types of displacement, such as motion in two or three dimensions.

Thermally actuated MEMS devices capable of motion in two or three dimensions have been developed. For example, Lucas NovaSensor of Fremont, Calif. has developed a variety of thermally actuated MEMS devices capable of moving in either two or three dimensions. The devices capable of movement in two dimensions typically comprise one or more arched beams that deflect within a plane in response to thermal actuation. The devices capable of movement in three dimensions are disposed within a plane parallel to the substrate when not thermally actuated. Once thermally actuated, these devices are moved out of this plane, such as by rotating or lifting out of the plane. Another class of thermally actuated devices designed for out of plane movement are disposed out of plane when not thermally actuated. For example, these devices include the thermally actuated devices described by U.S. Pat. No. 5,796,152 to Carr et al., and U.S. Pat. No. 5,862,003 to Saif et al. These devices typically have one end affixed to the substrate and another end free to move in response thermal actuation. Because of this design, the relative amount of movement out of plane is limited. In addition, while all the aforementioned devices can be disposed in an array, the amount of movement produced by the array is not increased proportionately to the number of devices that have been combined into the array.

While thermally activated MEMS structures able to move in one, two, and three dimensions have been developed, it would still be advantageous to develop devices better optimized for increased amounts of movement in these directions. For example, it would be advantageous to provide thermally actuated MEMS devices that could be scalably arrayed so as to correspondingly combine the displacement of individual devices within the array, thereby providing much greater displacement than conventional MEMS devices. Further, it would be advantageous to provide improved thermally actuated MEMS devices that could move along more than one dimension in response to thermal actuation thereof. For example, improved thermally actuated MEMS devices capable of relatively large displacement both in plane and out of plane are needed both for new applications and to better serve existing applications.

SUMMARY OF THE INVENTION

The present invention includes several thermally actuated microelectromechanical structures providing scalable movement in one or more dimensions that collectively address the shortcomings noted above with respect to conventional MEMS devices. In particular, the MEMS structures of the present invention are not only capable of movement in two and three dimensions, but when arrayed are also capable of significantly greater ranges of displacement than conventional thermally actuated MEMS devices.

As such, one embodiment according to the present invention provides a thermally actuated microelectromechanical structure comprising a microelectronic substrate, at least one anchor, and a pair of arched beams. The microelectronic substrate serves as the base upon which the thermally actuated microelectromechanical structure is disposed. In this regard, at least one anchor is affixed to the microelectronic substrate while the remainder of the MEMS structure is suspended from the anchor over the substrate. Each arched beam of the pair has a medial portion and two end portions. The opposed end portions of the pair of arched beams are operably interconnected. Further, the medial portion of one arched beam in the pair is connected to at least one anchor, such that the pair of arched beams extends from at least one anchor in a cantilever configuration overlying the microelectronic substrate. The pair of arched beams further arch once thermal actuation is applied thereto, thereby causing the pair of arched beams to correspondingly move along a predetermined path with respect to the microelectronic substrate. As such, the MEMS structure of this embodiment can provide movement along a one dimensional or two dimensional path, parallel to a plane defined by the microelectronic substrate.

The MEMS structure of this embodiment can also include a crossbeam disposed between the pair of arched beams so as to operably interconnect the opposite ends of the pair of arched beams. The crossbeam is preferably adapted to be heated less than the pair of arched beams when the microelectromechanical structure is thermally actuated. By tying the ends of the arched beams together with the crossbeam, the MEMS structure of the embodiment can provide significantly more displacement than conventional MEMS devices.

In one embodiment, the pair of arched beams are arranged such that concave portions of the pair of arched beams face one another, thereby defining a generally diamond shaped structure adapted to expand in response to thermal actuation. Alternatively, another embodiment is arranged such that convex portions of the pair of arched beams face one another, thereby defining a generally bowtie shaped structure adapted to compress in response to thermal actuation. A thermally actuated microelectromechanical array is further provided by the present invention, wherein the aforementioned thermally actuated microelectromechanical structures comprise cells within the array in order to provide even greater displacement.

One embodiment of the present invention provides a thermally actuated structure comprising a microelectronic substrate, at least one anchor affixed thereto, an arched beam, and a crossbeam. The arched beam has a medial portion and two end portions. The crossbeam operably connects the opposed end portions of the arched beam such that the separation of the medial portion from the crossbeam differs from the separation of the two end portions from the crossbeam. As such, the medial portion of the arched beam is arched with respect to the crossbeam. The anchor is connected to the arched beam, crossbeam, or both, such that the arched beam and crossbeam overlie the microelectronic substrate in a cantilever configuration. Thermal actuation causes the medial portion to arch further so as to alter the separation of the medial portion from the crossbeam, and thereby cause movement along a predetermined path with respect to the microelectronic substrate. If the separation of the medial portion from the crossbeam is greater than the separation of the two end portions therefrom, the medial portion arches further away from the crossbeam in response to thermal actuation. However, if the separation of the medial portion from the crossbeam is less than the separation of the two end portions therefrom, the medial portion arches further toward the crossbeam in response to thermal actuation.

In one additional embodiment, the thermally actuated microelectromechanical structure further comprises a guide surface and relatively low friction means for guiding thermally actuated structures along a guided path in response to thermal actuation. The means for guiding may comprise at least one roller or a track defined lengthwise in the guide surface. Each roller is disposed between the pair of beams and the rail surface, such that the pair of arched beams are guided along the predetermined path in response to thermal actuation by movement of the roller along the rail surface. The track receives the pair of arched beams and extends along the predetermined path of movement such that the pair of arched beams are guided and slide therealong in response to thermal actuation.

According to another embodiment of the present invention, a thermally actuated microelectromechanical structure is provided that moves in a plane that is nonparallel to the plane defined by the surface of the substrate. The MEMS structure of this embodiment comprises a microelectronic substrate, at least one anchor affixed to the substrate, and at least one arched beam connected to the anchor. Each arched beam has a medial portion and two end portions, and in the absence of thermal actuation is arched in a direction nonparallel with respect to a generally planar surface defined by the microelectronic substrate. When an arched beam is thermally actuated, the actuated arched beam further arches in the direction nonparallel to the generally planar surface such that the medial portion arches to a greater degree than the two opposed end portions thereof. The separation of the medial portion of each thermally actuated arched beam from the generally planar surface is accordingly further altered in response to selective thermal actuation thereof.

The arched beam of the MEMS structure of this embodiment may be formed in several ways. In one embodiment, the arched beam comprises a first layer and a second layer at least partially overlying the first layer. In this case, the medial portion and the two end portions are disposed in different layers. Alternatively, the arched beam may be formed of a single layer, such that the medial portion thereof smoothly arches between the opposed end portions.

Another embodiment of the thermally actuated microelectromechanical structure according to the present invention comprises a microelectronic substrate, a first arched beam, a second arched beam, an interconnecting bar, and at least one anchor that is affixed to the substrate and is also connected to at least one of the first arched beam, the second arched beam, and the interconnecting bar. The microelectronic substrate defines a generally planar surface, and serves as a base for the thermally actuated microelectromechanical structure. The first arched beam and second arched beam each comprise a medial portion and two end portions. In the absence of thermal actuation, the first arched beam is arched such that the medial portion is spaced further from the microelectronic substrate than the two opposed end portions. In contrast, in the absence of thermal actuation, the second arched beam is arched such that the medial portion is spaced closer to the microelectronic substrate than the two opposed end portions. The interconnecting bar operably interconnects the end portions of the first and second arched beams. When selective thermal actuation is applied to the MEMS structure of this embodiment, the arched beams further arch so as to alter the separation of the interconnecting bar from the generally planar surface. By operably mounting a platform to the interconnecting bar, the platform will therefore be moved nonparallel to the generally planar surface of the microelectronic substrate.

As before, the thermally actuated microelectromechanical structures can be cascaded to form cells within a thermally actuated microelectromechanical array. In one embodiment of an array according to the present invention, at least two thermally actuated cells are operably interconnected through the medial portion of the first upwardly arching beam of one thermally actuated cell and the medial portion of the second downwardly arching beam of an adjacent thermally actuated cell. In another array embodiment, at least two thermally actuated cells are operably interconnected through the medial portion of the first upwardly arching beams of two adjacent thermally actuated cells. Further, one array embodiment provides at least four adjacent thermally actuated cells, operably interconnected through the medial portions of the respective first arched beams. In any of these array embodiments, the separation of the interconnected medial portions from the generally planar surface defined by the microelectronic substrate is altered in response to selective thermal actuation of at least one of the interconnected thermally actuated cells. The aforementioned array embodiments may further comprise a platform operably connected to the interconnected medial portions of the adjacent thermally actuated cells, such that the separation of the platform from the generally planar surface may be altered by selective thermal actuation.

Further, the present invention provides a thermally actuated microelectromechanical array which combines the different types of thermally actuated cells described above. A first type of thermally actuated cell provides arched beams that move the corresponding cells within a plane parallel to an X-Y plane defined by the generally planar surface of the microelectronic substrate. Another type of thermally actuated cell provides arched beams that move the corresponding cells in the Z direction perpendicular to the X-Y plane, such that the separation from the X-Y plane is altered. As such, selective thermal actuation of cells within the thermally actuated microelectromechanical array provides motion parallel to, and/or perpendicular to, the X-Y plane defined by the microelectronic substrate. In addition, the present invention provides direct as well as indirect heating techniques for thermally actuating any arched beams described herein.

As such, the various embodiments of the MEMS structures described above can provide controlled movement in one, two and/or three dimensions. In addition, the MEMS structures of the present invention are capable of significantly greater displacement than conventional MEMS structures. As such, the MEMS structures of the present invention can address many of the heightened demands presented by modem applications.

DETAILED DESCRIPTION OF THE INVENTION

Figure 1A:
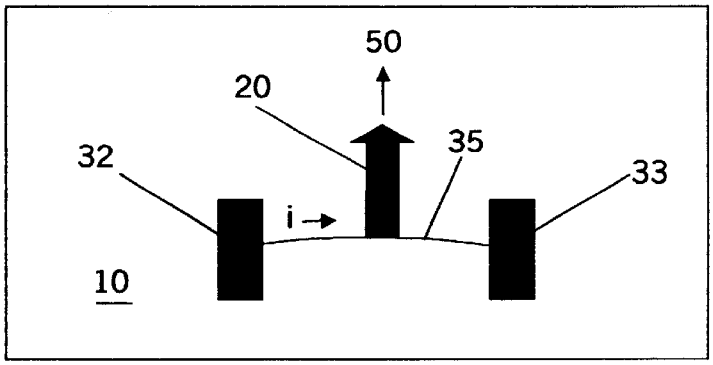
FIGS. 1(*a*), 1(*b*) and 1(*c*) provide plan views of several thermal arched beam actuator embodiments.

The present invention will now be described more fully hereinafter with reference to the accompanying drawings, in which preferred embodiments of the present invention are shown. The present invention may, however, be embodied in many different forms and should not be construed as limited to the embodiments set forth herein; rather, these embodiments are provided so that this disclosure will be thorough and complete, and will fully convey the scope of the present invention to those skilled in the art. Features in the drawings are not necessarily to scale, but merely serve to illustrate the present invention. Like numbers refer to like elements throughout.

The present invention provides thermally actuated microelectromechanical actuator structures and arrays that are scalable and can provide a substantial amount of displacement in multiple dimensions, for instance capable of substantial movement in one, two, and/or three dimensions. As used in the present invention, "scalable" refers to microelectromechanical actuator structures or cells that can be interconnected in an array so as to combine the displacement of each structure or cell therein in response to thermal actuation. All thermally actuated structure and array embodiments provided according to the present invention are disposed upon an underlying microelectronic substrate, preferably on a generally planar surface thereof. The underlying microelectronic substrate can be any suitable material, such as glass, silicon, other semiconductors, or other materials. For each embodiment of the present invention, the fundamental source of motive force comprises one or more thermally actuated thermal arched beam actuators, as will be described below.

Thermal Arched Beam Actuators

Figure 1B:
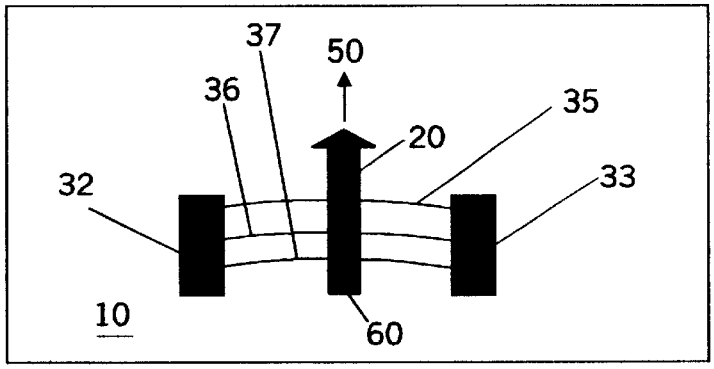
Figure 1C:
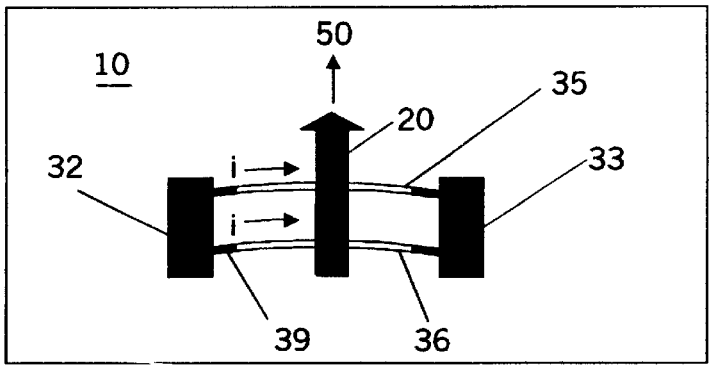
Figure 2A:
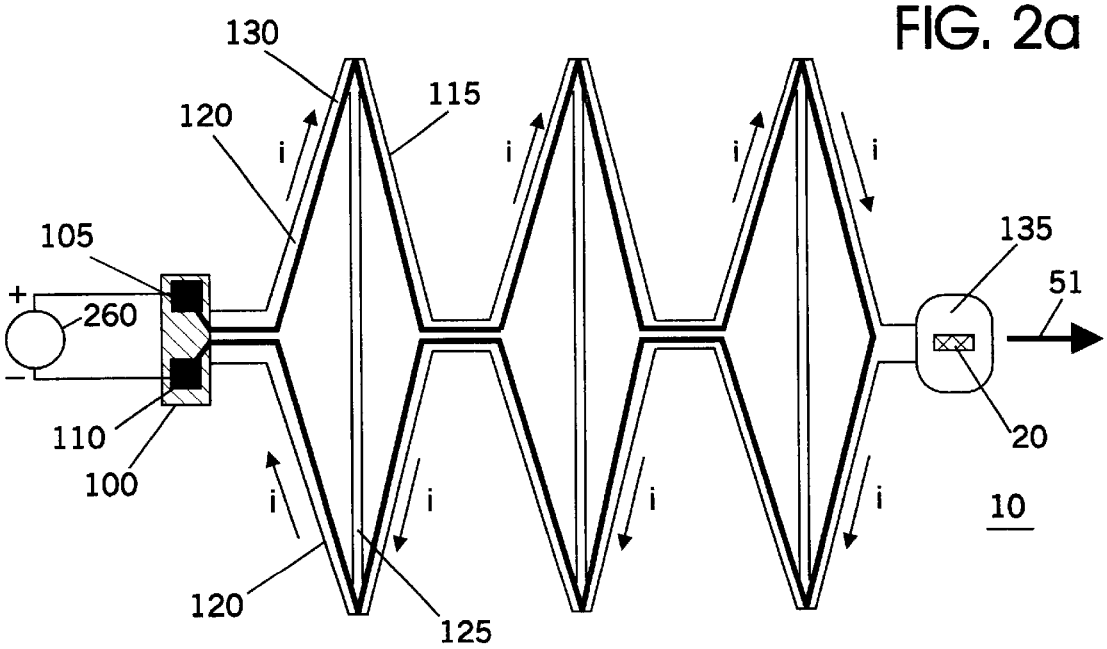
FIGS. 2(*a*) through 2(*d*) provide plan views of various in-plane thermal arched beam actuator embodiments, according to the present invention.
Figure 2C:
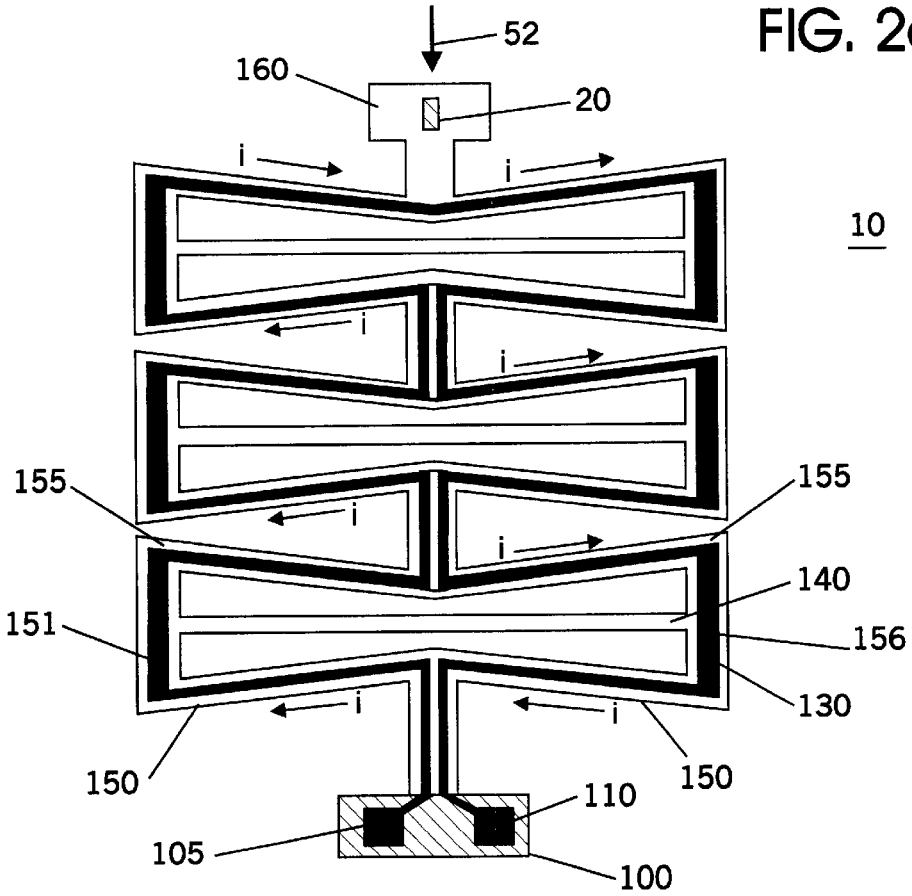
Figure 2B:
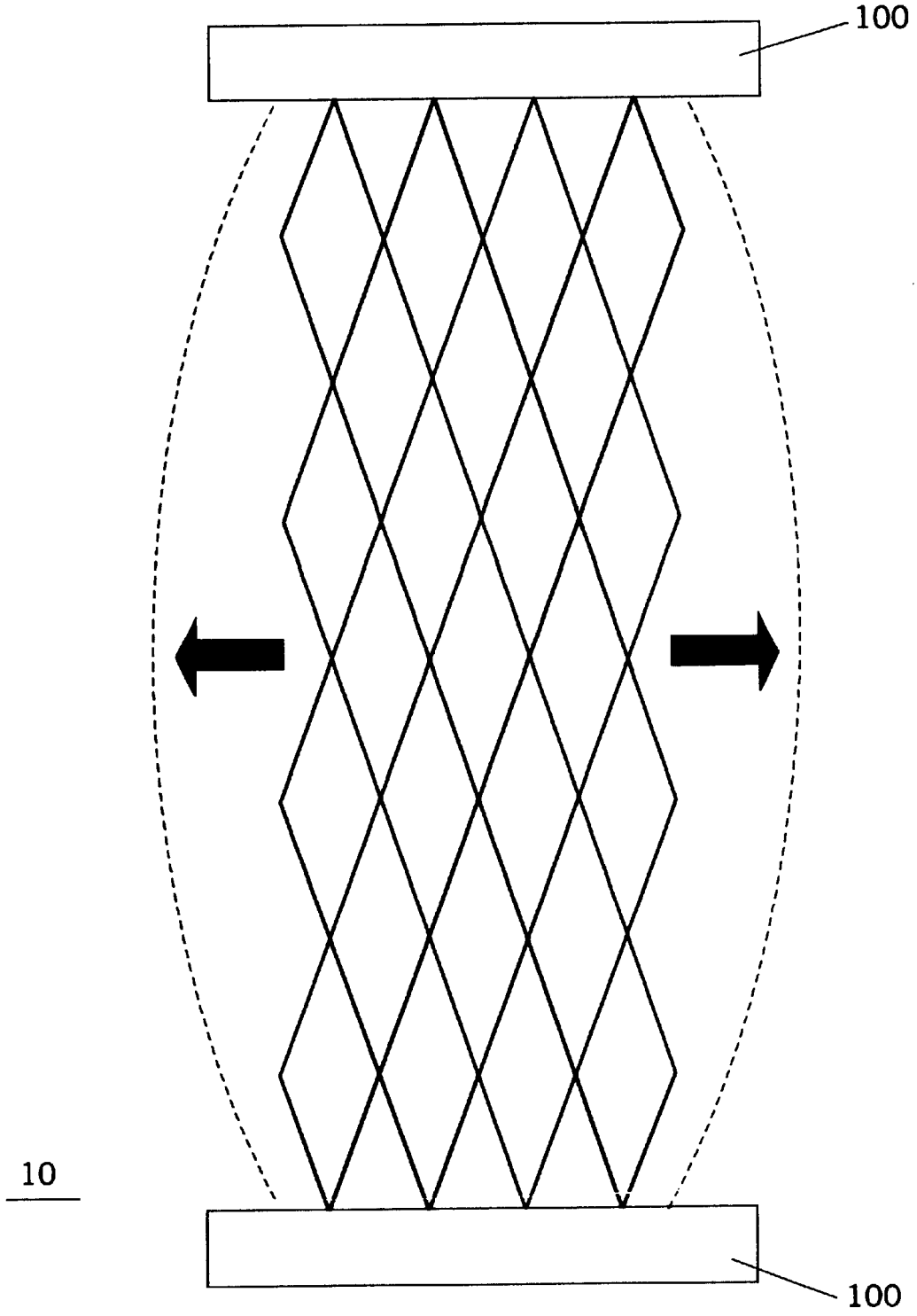
Figure 2D:
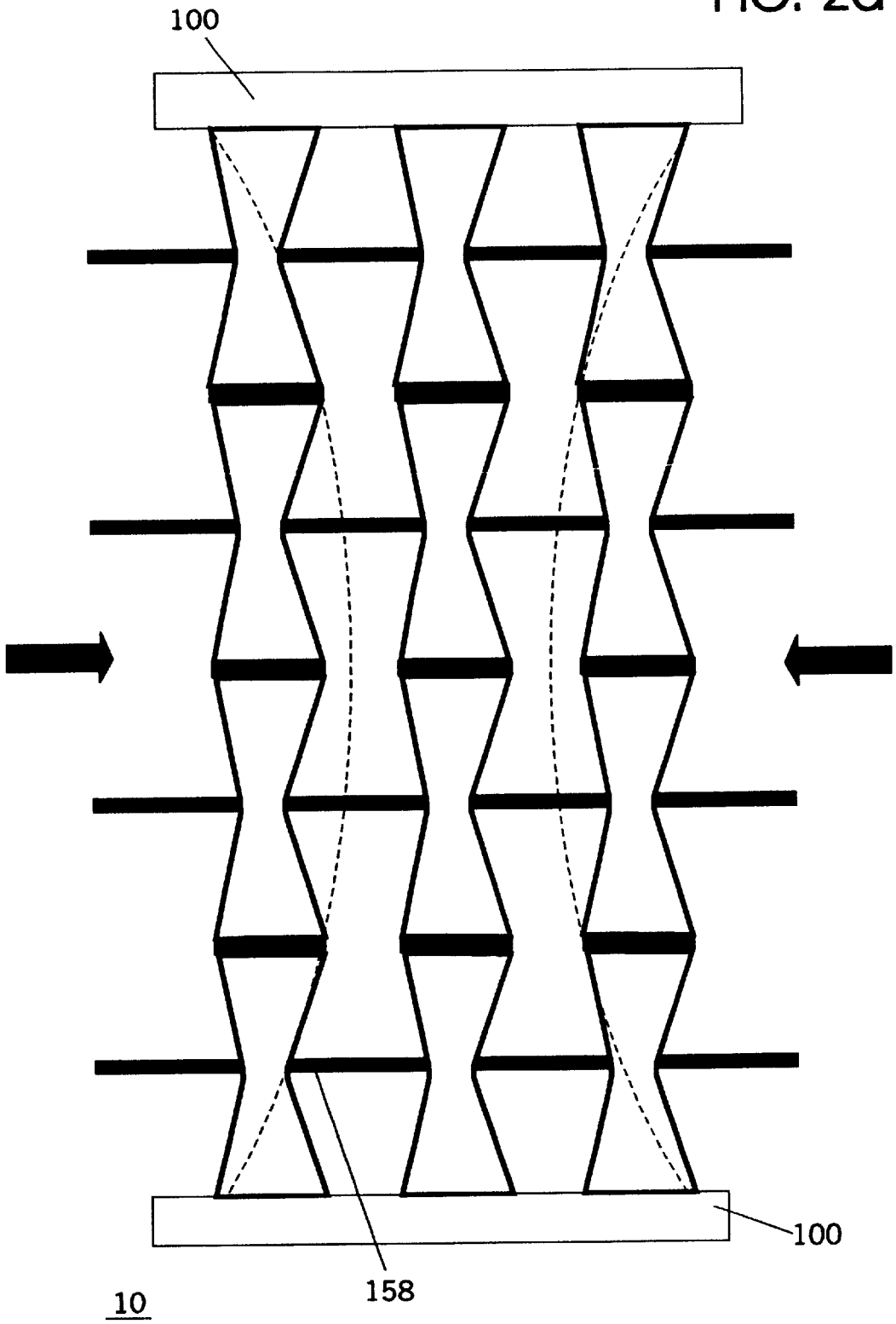

While thermally actuated microelectromechanical actuator structures according to the present invention can have many different embodiments, the structures are preferably actuated by thermal arched beam (TAB) actuators, such as those described in U.S. patent application Ser. No. 08/767,192, the contents of which have been incorporated by reference herein. In this regard, FIG. 1 illustrates some fundamental thermal arched beam actuator structures useful for understanding the operation thereof. As shown in FIGS. 1(*a*) and 1(*b*), a thermal arched beam actuator may comprise a single arched beam or multiple arched beams. In FIG. 1(*a*), an example of a single beam thermal arched beam actuator is shown. The single beam thermal arched beam actuator comprises at least two anchors, for example anchors 32 and 33 as shown. Each anchor is affixed to the microelectronic substrate 10 so as to provide support for the thermal arched beam actuator. Further, the thermal arched beam actuator includes one arched beam 35 disposed between at least one pair of anchors. The arched beam extends between a pair of anchors such that the ends of the arched beam are affixed thereto and the arched beam is supported overlying the microelectronic substrate.

In the absence of thermal actuation, the arched beam is arched in a predetermined direction 50. In addition, the arched beam is adapted to arch further in the predetermined direction in response to selective thermal actuation thereof. Thermal actuation of the arched beam can occur in many ways, such as by direct heating techniques in which electrical current is passed through the arched beam and indirect heating techniques in which the arched beam is heated by proximate heating sources. When the arched beam is thermally actuated and arches further, both force and displacement are provided. In other words, arched beam 35 displaces further in the predetermined direction in response to thermal actuation. As such, a platform 20 that is adapted for movement with the arched beam can be moved in predetermined direction 50 when arched beam 35 is thermally actuated. Once thermal actuation is removed, the arched beam will move opposite to the predetermined direction 50 so as to return to the initial non-actuated arched position.

As shown in FIGS. 1(*b*) and 1(*c*), thermal arched beam actuators can also include multiple arched beams disposed between a pair of anchors. For example, arched beams 35, 36, and 37 shown in FIG. 1(*b*) can be thermally actuated individually or collectively. As before, the arched beams are arched in a predetermined direction absent thermal actuation, and arch further in the predetermined direction in response to selective thermal actuation thereof. A coupler 60 as shown may be used to operably interconnect multiple arched beams, such that the displacement and force provided by each arched beam when thermally actuated may thereby be integrated.

The arched beams are preferably formed of a material which changes shape substantially, such as by expanding, in response to changes in temperature. While an arched beam can be created from material that has a negative thermal coefficient of expansion that contracts as temperature increases, preferably arched beams are constructed from materials having a positive thermal coefficient of expansion. Thus, an arched beam is preferably formed from a material that expands as the temperature increases, such that the arched beam arches further when thermally actuated. Further, while the thermal arched beam actuator is preferably formed from a metallic material, such as nickel, alternatively the thermal arched beams and/or other components of the thermal arched beam actuator, such as the anchors, may be formed from a single crystal material such as silicon. For components formed of nickel, U.S. patent application Ser. No. 08/736,598, incorporated by reference above, describes a nickel electroplating process that may alternatively be used to form these structures upon the microelectronic substrate. For arched beams and anchors formed of a single crystal material, such as silicon, the components can be formed by using established micro engineering techniques, such as surface micromachining. Of course, the thermal arched beam, anchors, and other components of any thermal arched beam actuator may be formed from different materials and/or in different material layers as required.

Thermal arched beam structures can be designed so as to optimize selected operational characteristics. The examples of thermal arched beam actuators shown in FIG. 1 are configured to provide relatively large mechanical stability, force, and robustness. In addition, these thermal arched beam actuators are typically adapted to move within a plane along one dimension, for instance, along the linear axis defined by the predetermined direction of movement 50. However, the thermal arched beams in these examples require relatively long arched beams and relatively high temperatures in order to provide a significant amount of deflection. That is, these TAB actuators are configured to provide optimum robustness, force, and mechanical stability but require a relatively larger substrate area and higher operating temperatures in order to provide a given displacement. As described below, it is possible to arrange TAB actuators in other configurations, for instance optimized to provide greater scalable displacement within a plane.

In-plane Displacement Actuator Structures and Arrays

Figures 3A, 3B, 3C, 3D:
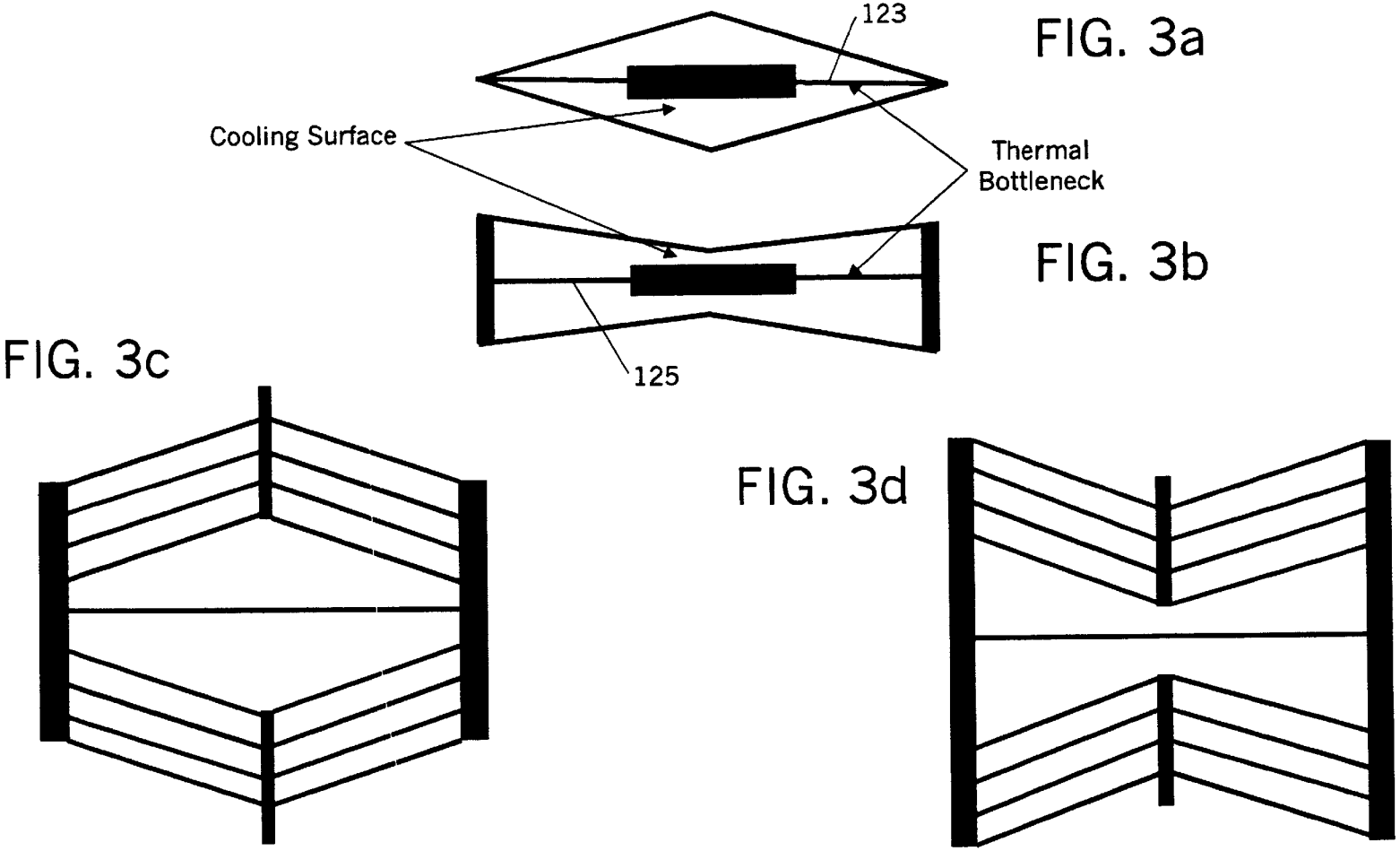
FIGS. 3(*a*) through 3(*d*) provide plan views of two crossbeam embodiments and two in-plane thermal arched beam array embodiments respectively, according to the present invention.

The present invention provides thermally actuated microelectromechanical structures adapted to provide a given displacement while requiring relatively lower operating temperatures and using relatively shorter arched beams than conventional TAB actuators. As such, these thermally actuated microelectromechanical structures include TAB actuators configured to minimize substrate area and operating temperatures required for a given amount of in-plane displacement. Further, relatively large amounts of displacement can be provided by configuring these scalable thermally actuated microelectromechanical structures in an array. As used in the present invention, an in-plane displacement structure is a structure capable of movement in one and/or two dimensions within a plane, such as generally parallel to the plane defined by the surface of the substrate. For instance, an in-plane displacement structure could move along an X-axis, along a Y-axis, or along both. In addition, structures capable of movement in one dimension can be interconnected advantageously such that movement in two dimensions may also be provided. Examples of these thermally actuated structures are shown in FIGS. 2 and 3.

In general, one embodiment of the present invention provides a thermally actuated microelectromechanical structure comprising a microelectronic substrate, at least one anchor affixed to the microelectronic substrate, and a pair of arched beams. Each arched beam has a medial portion and two end portions. As shown, the opposed end portions of the pair of arched beams are operably interconnected. Further, the medial portion of one arched beam within the pair is connected to at least one anchor, such that the pair of arched beams extends therefrom in a cantilever configuration overlying the microelectronic substrate. Each operably interconnected pair of arched beams is biased to arch in a predetermined direction in the absence of thermal actuation. Arched beams within each pair may be biased in the same direction, or in different directions, when not thermally actuated. When the pair of arched beams are thermally actuated, the pair of beams arch further to correspondingly move along a predetermined path with respect to the microelectronic substrate. The predetermined path is preferably linear along one dimension, in a plane parallel to a plane defined by the microelectronic substrate. For example, the predetermined path for the structure in FIG. 2(*a*) is along the direction defined by arrow 51. This generic thermally actuated microelectromechanical structure is scalable and can be configured in an array to provide different types and amounts of displacement within a plane.

One embodiment of the present invention provides a thermally actuated microelectromechanical structure configured to expand when the pair of arched beams is thermally actuated. An example thereof is shown in FIG. 2(*a*), wherein pairs of arched beams are adapted to provide a given displacement with relatively less substrate area, shorter arched beams, and lower operating temperatures. This embodiment is also scalable and may be configured in an array to provide relatively large amounts of displacement as required. The pair of arched beams adjacent the anchor 100 are configured and affixed to the anchor as described above. In particular, an anchor 100 affixed to microelectronic substrate 10 and a pair of thermal arched beams, denoted as 115 and 120 respectively, are provided in this embodiment.

As shown, the arched beams comprise a medial portion and two end portions, and the pair of arched beams are operably interconnected at the two opposed end portions. In addition, the arched medial portion of arched beam 120 is connected to anchor 100. Further, the pair of arched beams are arranged such that concave portions thereof face one another, thereby defining a generally diamond shaped structure. In other words, the pair of arched beams are biased such that the arched medial portions thereof are directed away from each other, even absent thermal actuation. In addition, the pair of arched beams are adapted to arch further and expand along the predetermined path shown by arrow 51 in response to thermal actuation thereof. Although the arched beams included in the diamond shaped actuator embodiments are shown including two linear segments in the Figures, the arched beams can also be formed from one smooth continuous segment or in other ways. Accordingly, this diamond shaped thermally actuated microelectromechanical structure is configured to displace by expanding when the constituent thermal arched beams are thermally actuated. When thermal actuation is removed therefrom, the diamond shaped thermally actuated microelectromechanical structure returns to its original position, such as the biased arched position.

Another embodiment of the present invention provides a thermally actuated microelectromechanical structure configured to compress when the pair of arched beams is thermally actuated. An example thereof is shown in FIG. 2(*c*), wherein pairs of arched beams are adapted to provide a given displacement with relatively less substrate area, shorter arched beams, and lower operating temperatures. As before, this embodiment is scalable and may be configured in an array to provide relatively large amounts of displacement. The pair of arched beams adjacent the anchor 100 are configured and affixed to the anchor as described above. In particular, an anchor 100 affixed to microelectronic substrate 10 and a pair of thermal arched beams, denoted as 150 and 155 respectively, are provided in this embodiment.

As illustrated in FIG. 2(*c*), the arched beams comprise a medial portion and two end portions. As before, the pair of arched beams are operably interconnected at the two opposed end portions. In contrast with the previous embodiment, the opposed end portions of the arched beams in this embodiment are operably interconnected through a frame portion, such as 151 and 156 as shown. Further, the arched medial portion of arched beam 150 is connected to anchor 100. In addition, the pair of arched beams are arranged such that convex portions thereof face one another, thereby defining a generally bowtie shaped structure. In other words, the pair of arched beams are biased such that the arched medial portions thereof are directed toward each other, even absent thermal actuation. Further, the pair of arched beams is adapted to arch further and compress along the predetermined path shown by arrow 52 in response to thermal actuation thereof. As with the diamond actuator embodiments, even though the arched beams included in the bowtie shaped actuator embodiments are shown including two linear segments in the Figures, the arched beams can also be formed from one smooth continuous segment or in other ways. Accordingly, this bowtie shaped thermally actuated microelectromechanical structure is configured to displace by compressing when the constituent thermal arched beams are thermally actuated. As before, when thermal actuation is removed therefrom, the bowtie shaped thermally actuated microelectromechanical structure returns to its original position, such as the biased arched position.

Other embodiments of the thermally actuated microelectromechanical structures according to the present invention provide additions and modifications to the aforementioned embodiments. In one embodiment, the thermally actuated structure further includes a crossbeam that is preferably disposed between the pair of arched beams so as to operably connect the two opposed ends of each pair of arched beams. For instance, the diamond structure in FIG. 2(*a*) provides crossbeam 125 disposed between the opposed end portions of arched beams 115 and 120, while the bowtie structure in FIG. 2(*c*) provides crossbeam 140 disposed between the opposed end portions of arched beams 150 and 155. The thermally actuated microelectromechanical structure requires an expansion gradient between the crossbeam and arched beam, such that the crossbeam expands less than or more than the arched beam, in order to operate properly. In other words, the crossbeam cannot expand the same amount as the arched beam. For example, this may be achieved by applying thermal actuation differently to, or selecting different materials for the crossbeam and arched beam. In addition, the diamond structure of FIG. 3(*c*) and the bowtie structure of FIG. 3(*d*) include a plurality of arched beams on each side of the crossbeam beam in a configuration optimized for applying relatively large amounts of force with the same amount of displacement along one dimension of movement. The crossbeam provides additional mechanical stability and support for the interconnected pair of arched beams. In addition, the crossbeams may be used advantageously in several ways to provide more efficient thermal actuation of thermal arched beams. As a result of their construction and the manner of heating the arched beams, the crossbeams are adapted to expand less than the thermal arched beams interconnected thereby. As such, the crossbeams limit the outward movement of the opposed ends of the arched beams such that the further arching of the arched beams results in significant arching and displacement of the medial portions of the arched beams. Accordingly, the crossbeams are preferably adapted to be heated less than the corresponding pair of thermal arched beams within each thermally actuated microelectromechanical structure, in order to conserve energy and limit the expansion of the crossbeams.

As shown in FIGS. 3(*a*) and 3(*b*), the crossbeams may include a thermal bottleneck that acts like a heatsink, such that the crossbeam will remain cooler and expand less than the pair of beams within the diamond or bowtie shaped structures. In other words, the crossbeam can be adapted as needed to have advantageous thermal characteristics. For example, the geometry of the crossbeam and/or materials used therein can permit a crossbeam to act as a heatsink or thermal bottleneck. Whether or not the crossbeam is formed of the same material as the corresponding thermal arched beams, the surface area of the crossbeam can be increased to better dissipate thermal energy and remain relatively cooler than the corresponding thermal arched beams. For example, as shown in the aforementioned Figures, the surface area of at least the medial portions of each crossbeam 125 can be wider than the remainder of the crossbeam and/or the thermal arched beams. Generally, the greater the surface area, the greater the thermal dissipation. In addition, the crossbeam may be formed from a different material than the thermal arched beam, so as to provide advantages as a heatsink and/or expand less than the corresponding thermal arched beams. For instance, materials with different thermal coefficients of expansion can be selected for the arched beams and crossbeams, such that the crossbeam will expand less when thermal actuation is applied. For instance, the pair of arched beams could be formed from a metallic material, while the crossbeam could be formed from silicon. Since silicon expands less than a metallic material, the crossbeam would expand significantly less than the arched beams as the temperature is increased. Further, forming the arched beams from a material having a larger thermal coefficient of expansion than the crossbeam will permit the thermally actuated MEMS structure to operate as a thermostat or temperature sensor, since displacement as a function of temperature can be characterized. As will be described, crossbeams can have other configurations so as to provide more efficient thermal actuation, whether direct or indirect heating techniques are used to provide thermal actuation.

One embodiment of the present invention provides a thermally actuated microelectromechanical structure comprising a microelectronic substrate, at least one anchor affixed thereto, an arched beam, and a crossbeam. The anchor and microelectronic substrate are as described above, and the anchor is affixed to the microelectronic substrate. Further, the arched beam has a medial portion and two end portions. A crossbeam operably connects the opposed end portions of the arched beam such that the separation of the medial portion from the crossbeam is different than the separation of the end portions from the crossbeam. As such, the medial portion of the arched beam is arched with respect to the crossbeam. The anchor is connected to the arched beam, the crossbeam, or both, such that the arched beam and crossbeam overlie the microelectronic substrate in a cantilever configuration. When thermal actuation is applied to the thermally actuated microelectromechanical structure, the arched beam further arches the medial portion thereof so as to alter the separation from the crossbeam, and thereby cause movement along a predetermined path with respect to the microelectronic substrate.

Figure 4A:
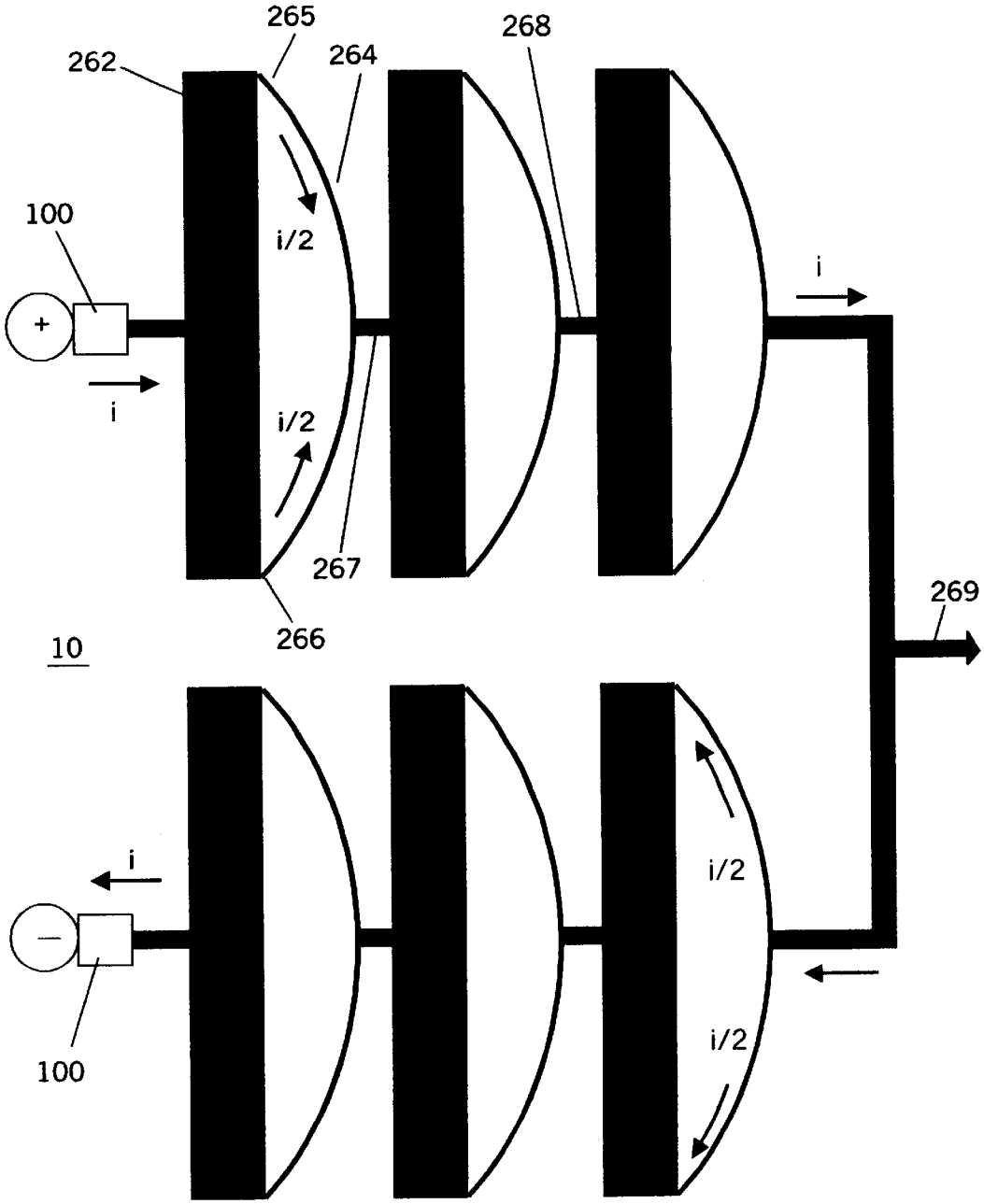
FIGS. 4(*a*) and 4(*b*) provide plan views of two direct heating embodiments for an in-plane thermally actuated array, according to the present invention.
Figure 4B:
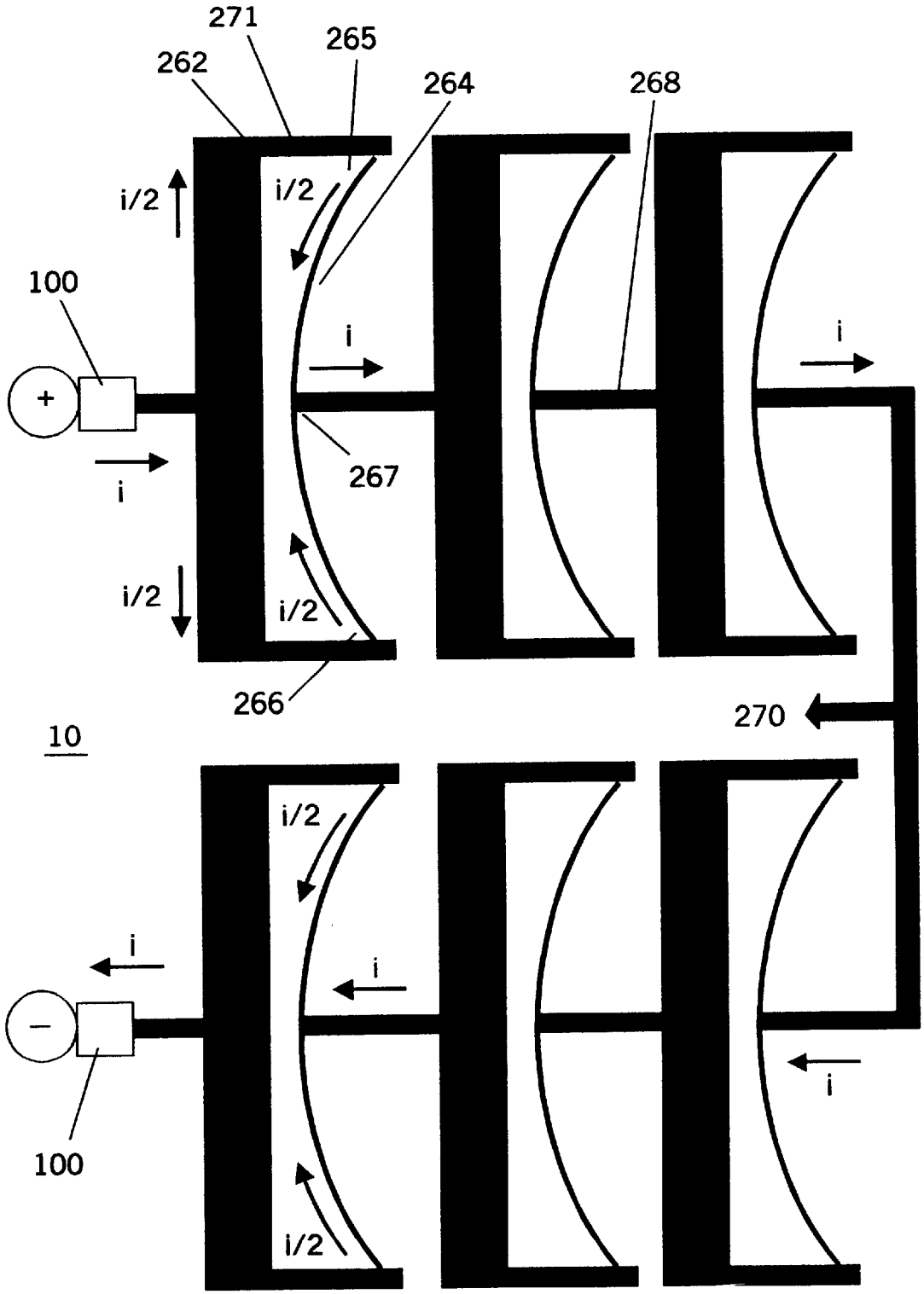

One example of a structure according to this embodiment is shown in FIG. 4(*a*). The microelectronic substrate 10 and anchor 100 are as described previously, while the arched beam 264 has a medial portion denoted as 267 and two end portions 265 and 266 respectively. The crossbeam 262 in this embodiment operably connects the opposed end portions 265 and 266 of the arched beam, such that the medial portion 267 arches away from the crossbeam, forming a generally D-shaped actuator structure in the absence of thermal actuation. In this case, the separation of the medial portion from the crossbeam is greater than the separation of the two end portions from the crossbeam. The anchor is operably connected to at least one of the arched beam and the crossbeam, such that the arched beam and crossbeam overlie the microelectronic substrate in a cantilever configuration. When thermal actuation is applied to at least the arched beam of the D-shaped actuator structure, the medial portion of the arched beam further arches away from the crossbeam so as to cause movement along a predetermined path, such as in the direction of arrow 269, with respect to the microelectronic substrate.

Another example of a structure according to this embodiment is shown in FIG. 4(*b*). As above, the microelectronic substrate 10 and anchor 100 are as described previously, and the arched beam 264 has a medial portion denoted as 267 and two end portions 265 and 266 respectively. In contrast, the crossbeam 262 has two side portions, such as 271, that form a C-shaped frame for supporting the arched beam. As before, the crossbeam operably connects the opposed end portions 265 and 266 of the arched beam. However, in this case the medial portion 267 arches toward the interior of the C-shaped crossbeam in the absence of thermal actuation. As such, the separation of the medial portion from the crossbeam is less than the separation of the two end portions from the crossbeam. The anchor is operably connected to at least one of the arched beam and the crossbeam, such that the arched beam and crossbeam overlie the microelectronic substrate in a cantilever configuration. When thermal actuation is applied to at least the arched beam of the thermally actuated actuator structure, the medial portion of the arched beam further arches toward the crossbeam so as to cause movement along a predetermined path, such as in the direction of arrow 270, with respect to the microelectronic substrate.

For the above embodiments, the crossbeam 262 may be implemented in various ways. In a preferred embodiment of the thermally actuated microelectromechanical structure, the crossbeam is adapted to be heated less than the arched beam when the microelectromechanical actuator structure is thermally actuated. For instance, an external heater may be disposed such that relatively more heat is provided to the arched beam than to the crossbeam. In addition, the crossbeam and arched beam can be formed from materials having different thermal coefficients of expansion, such that the arched beam and crossbeam respond differently to temperature variations. As above, preferably the crossbeam is formed of a material that expands less with rising temperatures than the arched beam. Further, the crossbeam can have a larger cross sectional area than the arched beam. As such, the crossbeam may have a lower electrical resistance than the arched beam if desired. Also, the crossbeam with a larger cross sectional area can serve as a heatsink, as described above.

In addition, a heater may be added to the aforementioned embodiments, disposed so as to selectively apply thermal actuation to the arched beam, crossbeam, or both. The heater can be external to the thermally actuated actuator structure, or may comprise a source of electrical energy for providing direct internal heating. One embodiment further comprises a plurality of thermally actuated cells, each thermally actuated cell comprising any of the aforementioned actuator structure embodiments. Each cell is interconnected to adjacent thermally actuated cells, such as through interconnecting member 268 as shown in FIGS. 4(*a*) and 4(*b*). As such, the plurality of thermally actuated cells cooperatively move along the predetermined path in response to thermal actuation of at least one cell. For instance, thermally actuating one or more D-shaped actuator cells within FIG. 4(*a*) will correspondingly move the array of D-shaped thermally actuated cells in the direction of arrow 269, while thermally actuating one or more actuator cells in FIG. 4(*b*) will accordingly move the array in the direction of arrow 270.

Figure 5:
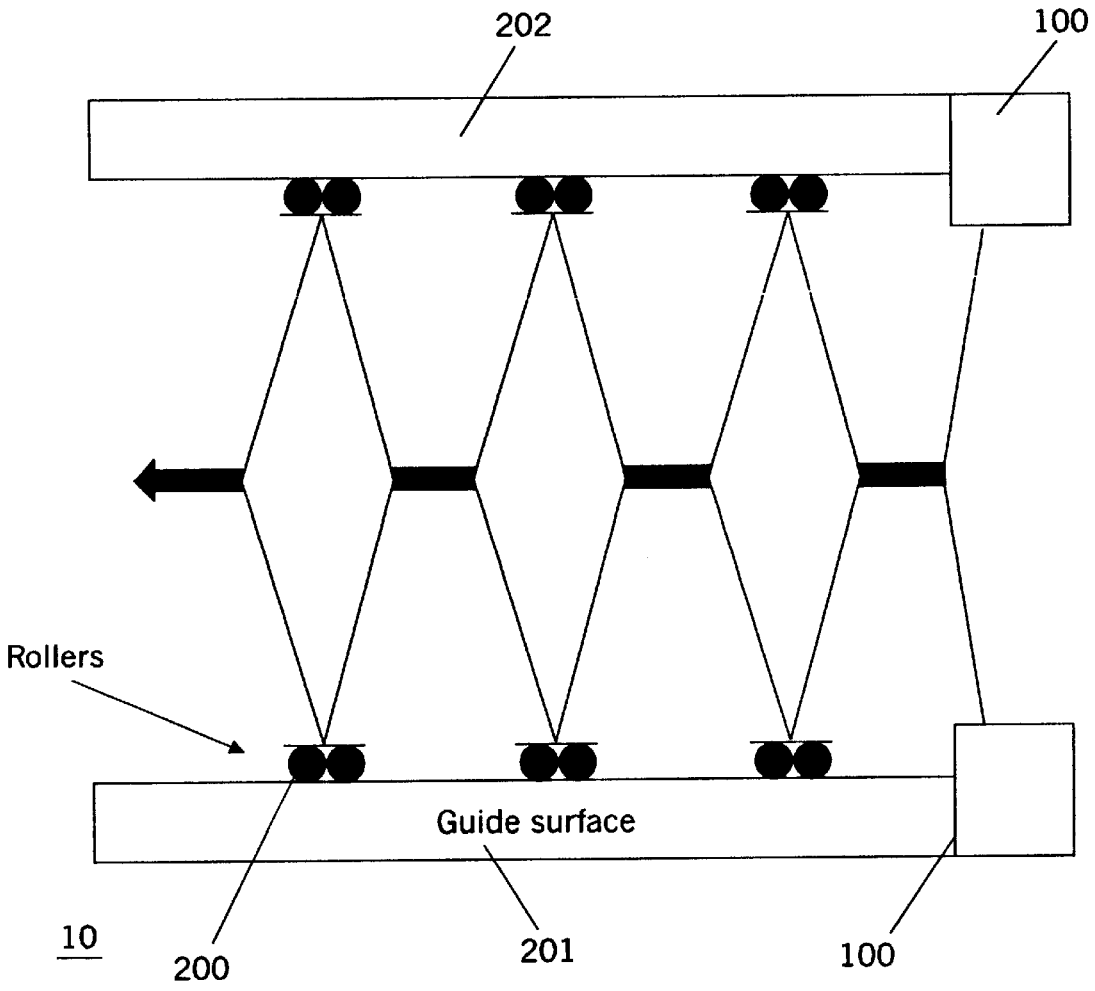
FIG. 5 provides a plan view of a rotatably guided thermal arched beam array embodiment, according to the present invention.
Figure 6A:
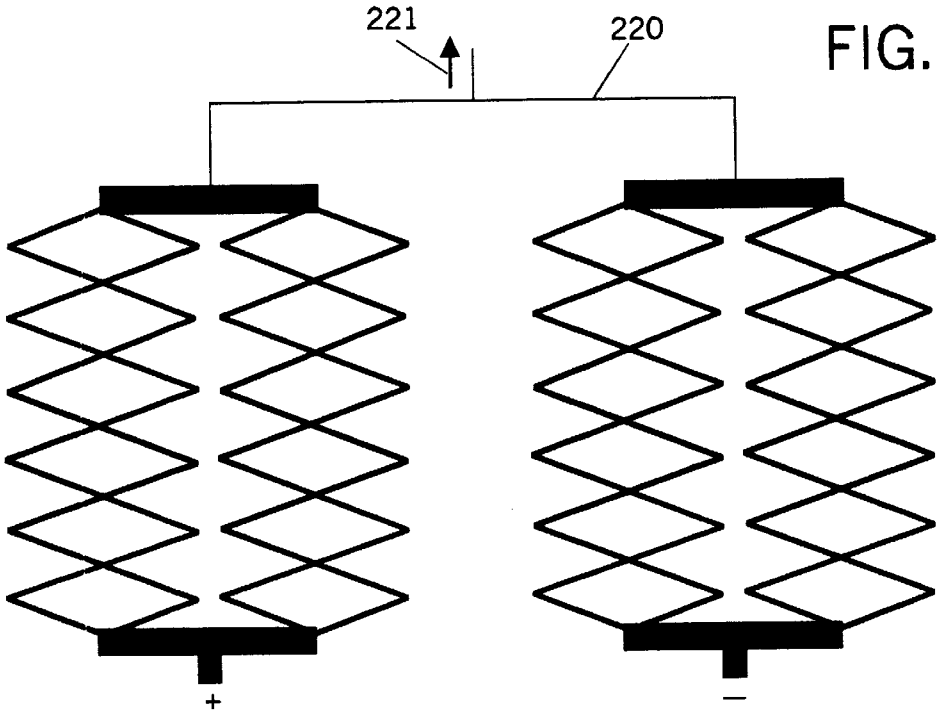
FIGS. 6(*a*) through 6(*f*) provide plan views of six in-plane thermally actuated array embodiments, according to the present invention.
Figure 6B:
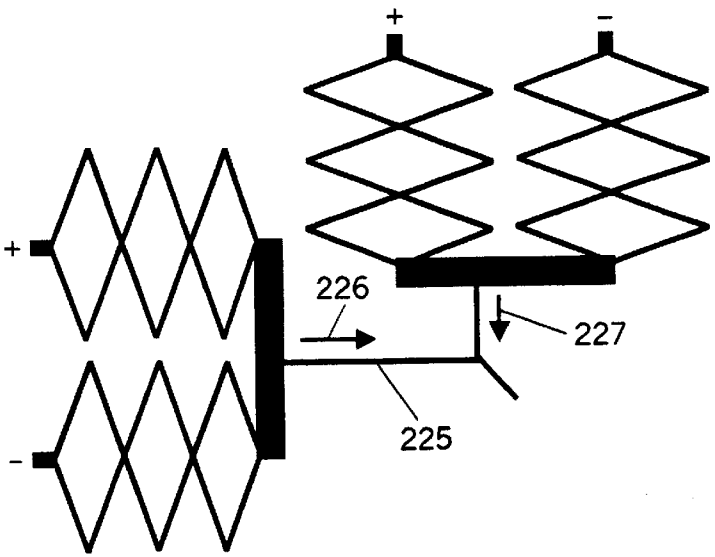
Figure 6D:
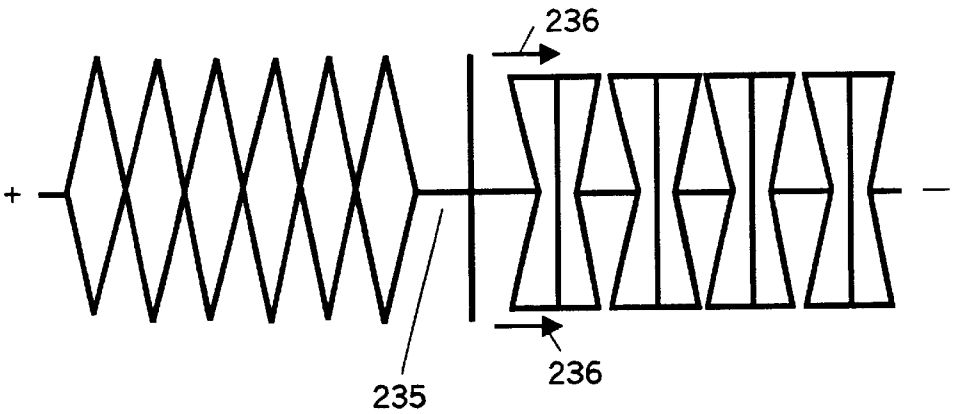
Figure 6C:
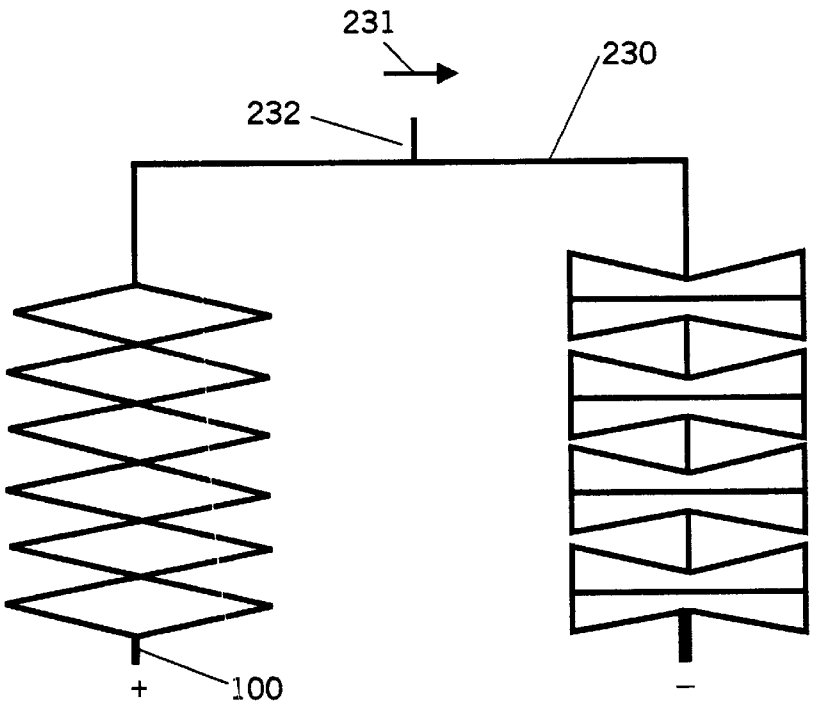
Figure 6F:
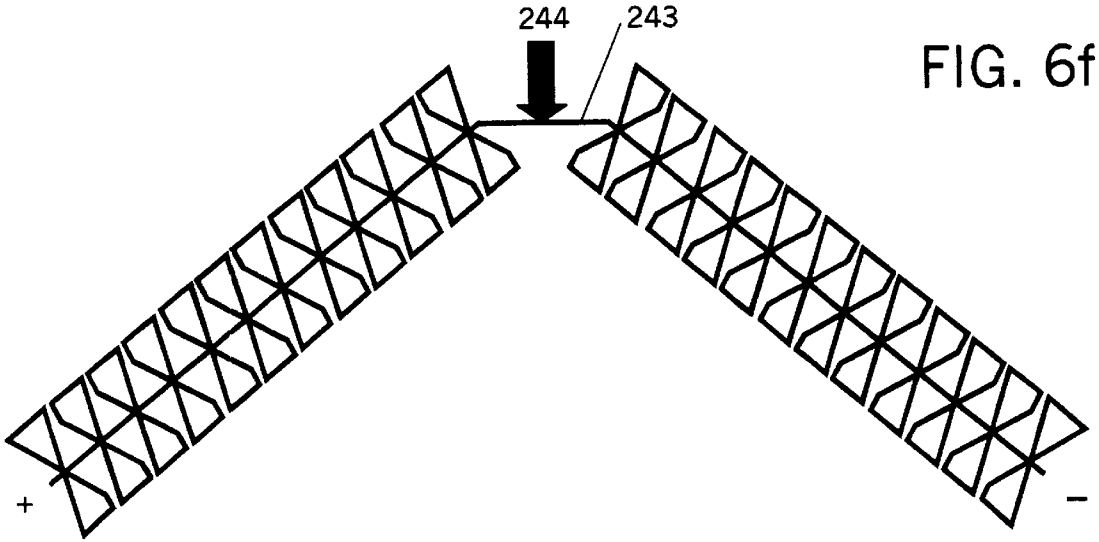
Figure 6E:
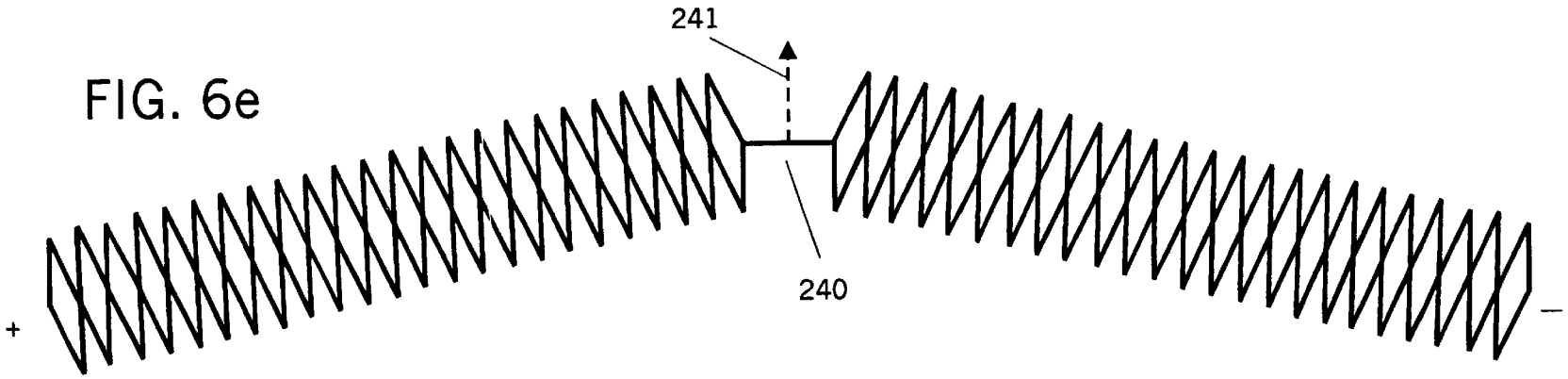

In another embodiment, the thermally actuated microelectromechanical structures according to the present invention may further comprise relatively low resistance means for guiding thermal arched beams along a path in response to thermal actuation thereof. As such, this embodiment permits guided movement with less friction for the thermally actuated microelectromechanical structures along a predetermined path, such as by providing a rolling or sliding interface. As shown in FIG. 5, at least one guide surface, such as guide surface 201 and/or 202, and at least one roller, such as roller 200 can be added to the diamond, bowtie, or any thermally actuated microelectromechanical structure described herein. The thermally actuated structure is preferably affixed to the microelectronic substrate at some point by at least one anchor 100. Further, each roller is disposed between an end of the pair of arched beams and an adjacent guide surface, typically formed by a portion of the microelectronic substrate, such that the pair of arched beams are guided along the predetermined path defined by arrow 203 by the movement of the roller along the guide surface, as the pair of arched beams displace in response to selective thermal actuation. As a further example, a sliding interface can be provided for the thermally actuated structure. A guide surface can be provided which defines a track extending lengthwise along the predetermined path of movement of a pair of thermally arched beams. The pair of arched beams can be received by the track and thereby guided along the predetermined path of movement in response to thermal actuation thereof. For example, the rollers could be removed from the pairs of arched beams in FIG. 4. In addition, the guide surface 201 or 202 could define a track which receives the pairs of arched beams and serves as a guide along the predetermined path of thermally actuated movement.

As described, multiple pairs of arched beams can be arranged to cooperatively respond to thermal actuation. Accordingly, one embodiment of the present invention provides a thermally actuated microelectromechanical array adapted to move along a one dimensional and/or two dimensional path of movement within a plane parallel to the plane defined by the microelectronic substrate. The thermally actuated microelectromechanical array may be formed by interconnecting at least two of any type of thermally actuated microelectromechanical structures described herein, preferably at least two of the same type of thermally actuated microelectromechanical structures. Since the thermally actuated microelectromechanical structures are scalable, relatively large amounts of displacement may be provided by configuring these structures in an array. Generically, the thermally actuated microelectromechanical array provided in one embodiment of the present invention comprises a microelectronic substrate and at least one anchor affixed thereto, as previously described. In addition, the array comprises a plurality of thermally actuated microelectromechanical cells. Each thermally actuated microelectromechanical cell comprises a pair of arched beams operably connected at opposite ends thereof as described previously. A first thermally actuated microelectromechanical cell is connected to at least one anchor, such as via a medial portion of one of the arched beams, and extends therefrom. The remainder of the thermally actuated microelectromechanical cells in the array are connected to one another such that each cell is operably connected to the first thermally actuated microelectromechanical cell. As such, the plurality of microelectromechanical cells extend from at least one anchor in a cantilever-like configuration overlying the microelectronic substrate, so as to provide the required amount of displacement.

As before, the operably connected pair of arched beams within each cell are arched in a predetermined direction in the absence of thermal actuation. When selective thermal actuation is applied to at least one thermally actuated microelectromechanical cell, the arched beams therein further arch, thereby causing the plurality of thermally actuated cells in the array to correspondingly move along a predetermined path with respect to the microelectronic substrate. Of course, thermal actuation may be applied to part or all of the thermally actuated cells of the thermally actuated microelectromechanical array. When thermal actuation is no longer applied to a thermally actuated cell, the arched beams therein resume the initial arched position. Those skilled in the art will understand that the crossbeam, guided rolling or sliding means, heating techniques, and other modifications and enhancements can be applied to any of the thermally actuated microelectromechanical structures and cells described herein, as well as to any thermally actuated microelectromechanical arrays formed therefrom.

The aforementioned diamond and bowtie shaped thermally actuated microelectromechanical structures provided by the present invention may be advantageously arrayed in many other embodiments. For instance, FIGS. 2(*a*) and 2(*b*) illustrate two examples of thermally actuated microelectromechanical arrays that may be created from a plurality of diamond shaped thermally actuated microelectromechanical structures or cells. In order to better illustrate these relatively complex arrays, diamond and bowtie cells may be shown schematically without the crossbar. Of course, this is for purposes of illustration only, and each diamond or bowtie cell comprising an array preferably includes a crossbar. As shown in FIG. 2(*a*), the diamond shaped cells may be disposed end-to-end serially in a lengthwise configuration optimized for displacement by expanding along one dimension of movement. In addition, as shown in FIG. 2(*b*), the diamond shaped cells may be disposed in a matrix or honeycomb-like array configuration optimized for relatively wide displacement along one dimension of movement, as shown by the dashed lines. In this honeycomb-like array, the array is anchored to the microelectronic substrate at one or more diamond shaped cells disposed at each side of the array.

By analogy, FIGS. 2(*c*) and 2(*d*) illustrate two examples of thermally actuated microelectromechanical arrays that may be created from a plurality of bowtie shaped thermally actuated microelectromechanical structures or cells. As shown in FIG. 2(*c*), the bowtie shaped cells may also be disposed end-to-end serially in a lengthwise configuration optimized for displacement by compressing along one dimension of movement. In addition, as shown in FIG. 2(*d*), the bowtie shaped cells may also be disposed in a matrix or honeycomb-like array configuration optimized for relatively wide displacement along one dimension of movement. As shown, adjacent bowtie cells may be interconnected by a link member 158. In addition, this honeycomb-like array is anchored to the microelectronic substrate at one or more bowtie shaped cells disposed at each side of the array.

As may be apparent to those skilled in the art, many permutations and combinations of thermally actuated arrays capable of movement in one and/or two dimensions may be created from the thermally actuated microelectromechanical structures and cells described herein. In addition, by arranging these scalable structures and cells in an array, relatively large amounts of displacement may be provided. Some thermally actuated arrays can combine the aforementioned structures, cells, and arrays such that motion can occur along two dimensions within a plane parallel to the plane defined by the underlying microelectronic substrate. At least some examples of these thermally actuated arrays will be described in conjunction with FIGS. 6(*a*) through 6(*f*).

As shown in FIG. 6(*a*), multiple diamond shaped thermally actuated arrays like those shown in FIG. 2(*a*) can be paired and combined within one thermally actuated array. Pairs of diamond shaped arrays are disposed in parallel and interconnected by a lateral member 220. By thermally actuating at least one of the paired diamond shaped arrays, the multiple diamond shaped thermally actuated array can move accordingly. If diamond arrays disposed on only one side of the structure are thermally actuated, for instance when either the diamond arrays in the "+" side or "−" side are actuated, then the multiple diamond shaped thermally actuated array will rotate somewhat toward the non-thermally actuated side. If diamond arrays in both sides are thermally actuated, then the multiple diamond shaped thermally actuated array will move generally linearly along the dimension defined by the arrow 221. The multiple diamond shaped thermally actuated array structure can therefore provide some degree of rotation and relatively large displacement, along one or two dimensions as desired, as well as relatively large amounts of force due to the parallel arrangement of the diamond shaped arrays.

The embodiment of FIG. 6(*b*) provides another multiple diamond shaped thermally actuated array formed from diamond arrays as before. As described, thermally actuated diamond structures or cells can be interconnected to form four arrays, arranged as two paired arrays. Further, the two paired arrays can be interconnected to form one combined thermally actuated array. The individual or paired bowtie arrays can be selectively thermally actuated as before. However, in contrast to the parallel paired diamond arrays shown in FIG. 6(*a*), the paired diamond arrays are disposed at right angles with respect to each other, and interconnected by an L-shaped member 225 that is connected to the distal end of each paired diamond array. As such, selective thermal actuation of the paired diamond arrays proximate arrow 226 causes the L-shaped member to move in the direction of arrow 226. In contrast, selective thermal actuation of the paired diamond arrays proximate arrow 227 correspondingly causes the L-shaped member to move in the direction of arrow 227. By thermally actuating one or both paired diamond arrays, either equally or to different degrees, the L-shaped member can be moved as desired, such as in the direction of either arrow or otherwise within the plane containing the paired diamond arrays.

In contrast, FIGS. 6(*c*) and 6(*d*) demonstrate that bowtie and diamond shaped thermally actuated arrays can be advantageously combined within a larger thermally actuated array. The arrays in each of these Figures are anchored, such as by anchor 100, and each is connected to a source of thermal actuation, such as a source of electrical energy, proximate portions labeled "+" and "−" respectively. The first example in FIG. 6(*c*) shows that diamond and bowtie shaped thermally actuated arrays can be interconnected in parallel through a lateral member 230. Thermally actuating only the "+" side diamond shaped thermally actuated array causes expansion therein which rotates the lateral member in the direction of the arrow 231. Further, thermally actuating only the "−" side bowtie shaped thermally actuated array causes compression therein to also rotate the lateral member in the direction of the arrow 231. Of course, thermally actuating both sides causes even greater rotation in the direction of arrow 231. As shown, a small beam 232 can be connected perpendicularly to the lateral member. As thermal actuation is applied, the small beam can accordingly rotate back and forth, similar to needles used in analog instruments, such as in an analog voltmeter. In the embodiment shown in FIG. 6(*c*), the bowtie and diamond shaped arrays work together to provide various amounts of rotation in the direction of the arrow as described herein.

However, the bowtie and diamond shaped arrays can also be connected in series to work together in a push-pull configuration. As shown in FIG. 6(*d*), one diamond shaped thermally actuated array labeled "+" is operable connected in series to a bowtie shaped thermally actuated array labeled "−". The bowtie and diamond shaped arrays are interconnected by a lateral member 235 that perpendicularly intersects each array. Of course, members having other shapes can be used to interconnect the bowtie and diamond arrays. Thermally actuating only the "+" side diamond shaped thermally actuated array causes expansion therein which moves the lateral member in the direction of the arrows 236. In addition, thermally actuating only the "−" side bowtie shaped thermally actuated array causes compression therein to also move the lateral member in the same direction. Thus, thermally actuating both sides causes even greater movement in the direction of the arrows 236 since the compression and expansion of the arrays work in unison. As before, greater force is provided collectively when the diamond array expands as the bowtie array simultaneously compresses.

In addition, thermally actuated arrays can be combined to create thermal-arched-beam-like structures responsive to thermal actuation. As shown in FIG. 6(*e*), two diamond shaped thermally actuated arrays may be serially interconnected, such as through member 240. In the absence of thermal actuation, the diamond shaped cells or structures in the arrays arch, such as in the direction of arrow 241. Accordingly, this array represents a thermally actuated structure similar to a thermal arched beam formed of material having a positive thermal coefficient of expansion, as discussed previously. Further, when thermally actuated, the individual diamond structures will expand more, so as to cause the interconnected arrays to further arch and displace in the direction of arrow 241. In contrast, FIG. 6(*f*) shows two bowtie shaped thermally actuated arrays, also interconnected serially, such as through member 243. In this case, the combined bowtie arrays arch in a direction opposite to arrow 244 in the absence of thermal actuation. When thermally actuated, the individual bowtie structures will compress more, so as to collectively cause the interconnected arrays to displace further in the direction of arrow 244. The latter interconnected bowtie arrays respond analogously to a thermal arched beam constructed from a material having a negative thermal coefficient of expansion. The serially connected diamond shaped arrays will expand and further arch, similarly to a typical thermal arched beam, in response to thermal actuation. Further, in response to thermal actuation, the serially connected bowtie shaped arrays will compress, tending to arch less and straighten. Those skilled in the art will appreciate that only a few examples of thermally actuated arrays according to the present invention have been provided. It is significant that the arrays provided herein can provide substantial displacement in one and/or two dimensions within a plane, and that the arrays may accordingly be interconnected in a plurality of ways. Further, the present invention provides thermally actuated structures and arrays that can move the third dimension out-of-plane, or in all three dimensions.

Out-of Plane Displacement Actuator Structures and Arrays

Accordingly, one embodiment of the present invention provides a thermally actuated microelectromechanical structure capable of movement in a third dimension, that is, movement that alters the separation from the underlying microelectronic substrate in response to thermal actuation. As before, this embodiment is scalable and may be configured in an array to provide relatively large amounts of displacement. Typically, the thermally actuated structure according to this embodiment is adapted to displace or move in a direction perpendicular to the plane defined by the generally planar surface of the underlying microelectronic substrate. However, the thermally actuated structure can provide movement in other directions that are nonparallel to the generally planar surface, if desired.

The thermally actuated microelectromechanical structure of this embodiment comprises a microelectronic substrate defining a generally planar surface, at least one anchor affixed to the microelectronic substrate, and at least one arched beam connected to the anchor. The microelectronic substrate and anchor are as described previously. While each arched beam has a medial portion and two end portions, as described above, at least one arched beam is arched in a direction that is nonparallel with respect to the generally planar surface of the substrate in the absence of thermal actuation. As such, at least one arched beam is biased in a nonparallel direction with respect to the generally planar surface when not thermally actuated. When the arched beam is thermally actuated, the arched beam correspondingly arches further in the same nonparallel direction with respect to the generally planar surface. As before, the medial portion of the arched beam arches to a greater degree than the two opposed end portions. Thus, the separation of the medial portion from the generally planar surface defined by the underlying microelectronic substrate can be altered accordingly. For example, the medial portion can arch so as to move closer to, or further from, the generally planar surface, depending on the direction in which the arched beam is originally arched. In other words, if the generally planar surface were assumed to represent an X-Y plane, the medial portion could correspondingly move along the Z axis, nonparallel to the X-Y plane. Those skilled in the art will appreciate that these thermally actuated structures can move along the Z axis in either sense, such as toward or away from the X-Y plane defined by the generally planar surface of the microelectronic substrate. In the case where these structures move toward the generally planar surface, trenches or cavities may be etched or otherwise formed in the microelectronic substrate, such that the thermally actuated structures can enter into the trench and/or penetrate completely through the microelectronic substrate. Depending upon the construction and configuration of the thermally actuated microelectromechanical structure and the manner in which the arched beams are arched, the thermally actuated microelectromechanical structure can thereby be configured to provide different types of out-of-plane displacement in the third dimension.

Figure 7A:
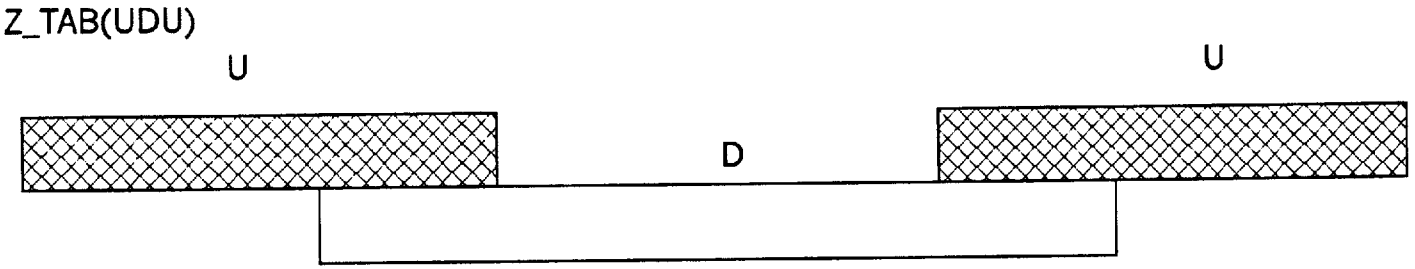
FIGS. 7(*a*) and 7(*b*) provide plan views of U-D-U and D-U-D out-of-plane thermally actuated structure embodiments, according to the present invention.
Figure 7B:
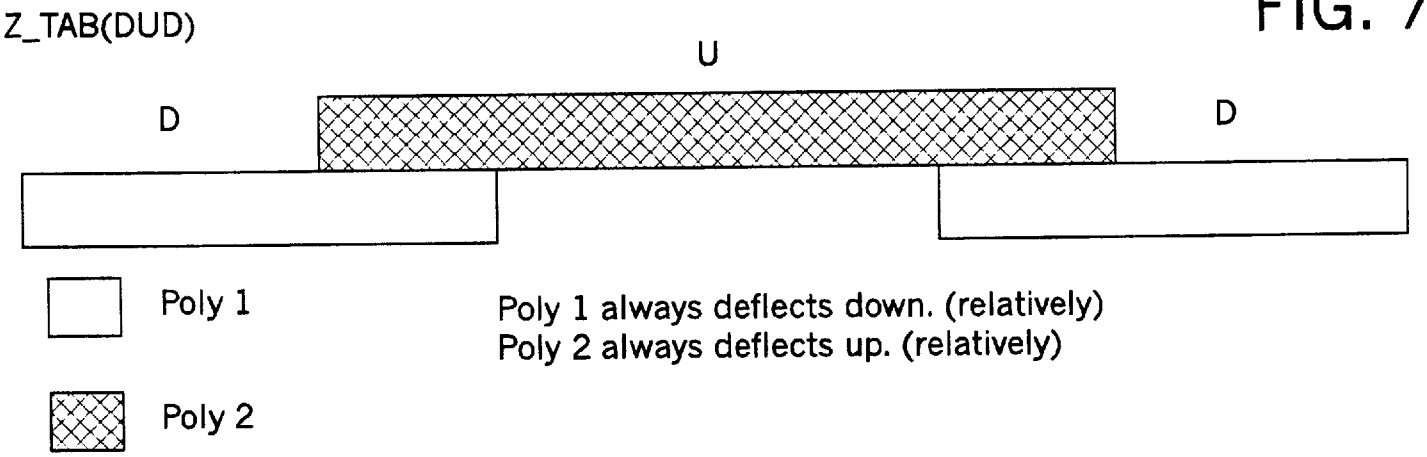

One embodiment of the thermally actuated microelectromechanical structure according to the present invention is shown in FIG. 7(*a*). This embodiment is capable of movement in a third dimension, in particular toward the generally planar surface in response to thermal actuation thereof. The medial portion of at least one thermal arched beam is accordingly arched in a direction toward the generally planar surface, such that the medial portion arches further toward the generally planar surface in response to thermal actuation of the corresponding arched beam. This configuration is referred to as a U-D-U (Up-Down-Up) structure, because the end portions of the arched beam are disposed "up" since they are farther away from the generally planar surface of the substrate than the corresponding medial portion, which is relatively "down". Accordingly, "Down" corresponds to a portion of an arched beam disposed relatively closer to the generally planar surface, whereas "Up" correspond to a portion disposed relatively further away therefrom. Accordingly, for this embodiment the medial portion is lower, or down closer to the substrate, as compared to the two relatively higher "up" end portions. Although not shown, the end portions of the arched beams are generally connected to anchors as described above, or to some other reference structure, such as an interconnecting bar.

Figure 8:
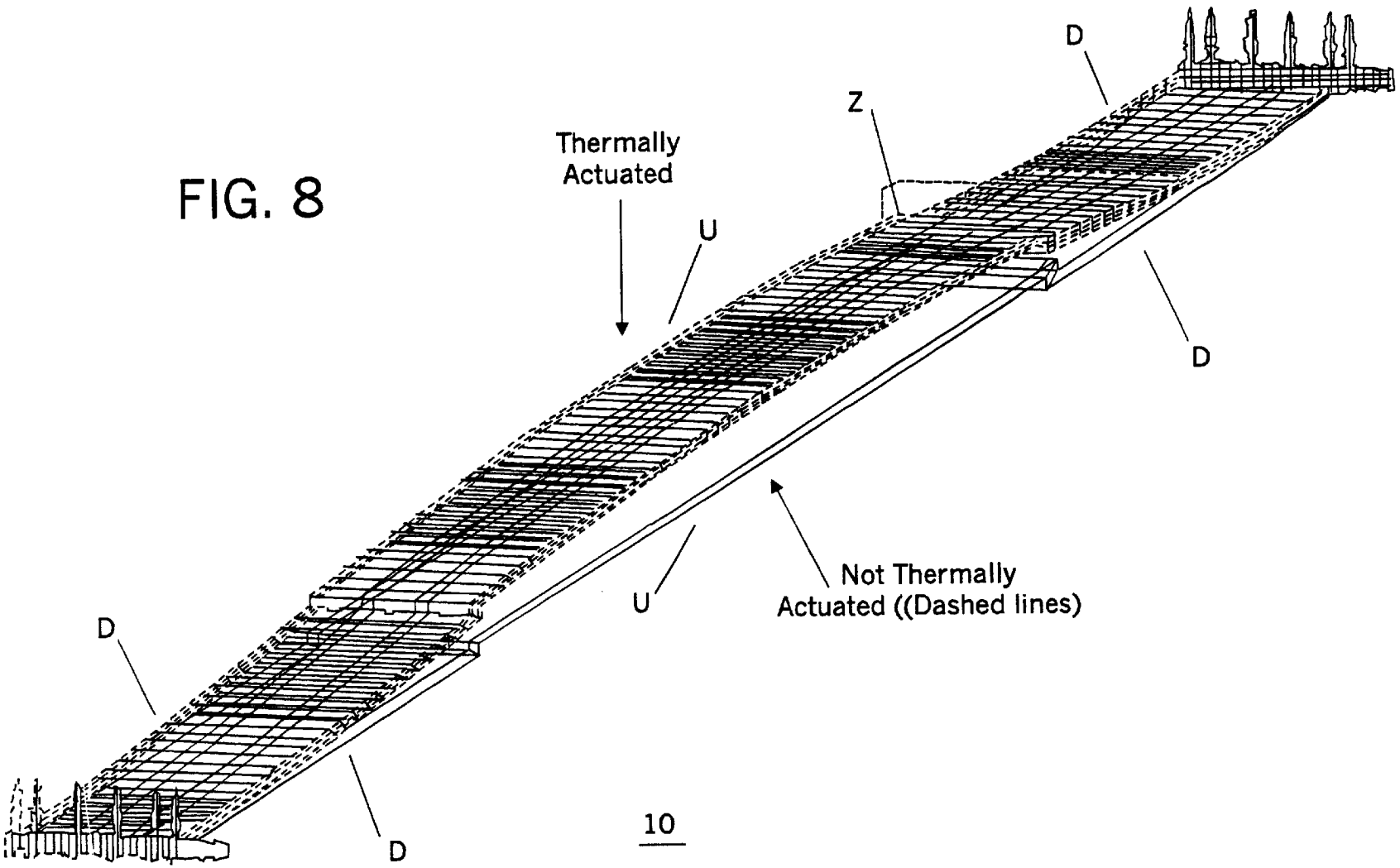
FIG. 8 provides a perspective view of a D-U-D out-of-plane thermally actuated structure embodiment, according to the present invention.

An analogous embodiment of the thermally actuated microelectromechanical structure according to the present invention is shown in FIG. 7(*b*), which reflects a D-U-D (Down-Up-Down) structure. This embodiment is also capable of movement in the third dimension, however, in particular movement is a direction away from the generally planar surface of the substrate in response to thermal actuation thereof. In this case, the medial portion of at least one thermal arched beam is accordingly arched in a direction away from the generally planar surface, such that the medial portion arches further away from toward the generally planar surface in response to thermal actuation the corresponding arched beam. In other words, in this D-U-D embodiment, the medial portion of the arched beam is disposed farther away from the generally planar surface than the corresponding end portions thereof. An example of a D-U-D beam structure, in both the non-actuated and thermally actuated states is shown in FIG. 8. The non-thermally actuated representation is shown by the dashed lined underlying the more arched thermally actuated state of the D-U-D structure, which is represented by the darker solid lines.

As shown in FIG. 7, the U-D-U, and D-U-D structures may be formed from two or more layers of material deposited through established microengineering techniques and processes. Accordingly, at least one arched beam may comprise a first layer nearest the underlying microelectronic substrate and a second layer, further from the substrate, deposited so as to at least partially overlie the first layer. For example, as shown in the Figure, first and second layers of polysilicon can be used to create U-D-U and D-U-D structures, such that the medial portions and respective end portions are correspondingly formed from different layers of polysilicon. Accordingly, two or more fabrication steps would be required to deposit the first and second layers corresponding to the D and U portions respectively.

However, U-D-U and D-U-D structures may be formed from a single layer of material. For example, a sacrificial layer having different regions with varying heights and areas could be deposited onto the microelectronic substrate. Next, a layer of thermally responsive material, such as a layer of polysilicon, may be deposited over the sacrificial regions. Since the layer of thermally responsive material conforms to the contour of the sacrificial layer and exposed substrate surfaces, the layer of thermally responsive material can have a similarly curved shape. The sacrificial layer can thereafter be removed, such that an arched beam is formed from a single material layer, that has medial and end portions as previously described. The arched beam is released from the substrate such that the medial portion has a different separation from the underlying substrate than the end portions. Accordingly, the medial portion of the arched beam smoothly arches between the two opposed end portions of the beam. As will be apparent, various materials and established microengineering techniques may also be used to create U-D-U and D-U-D structures from a single conformal layer.

Figures 9A, 9B:
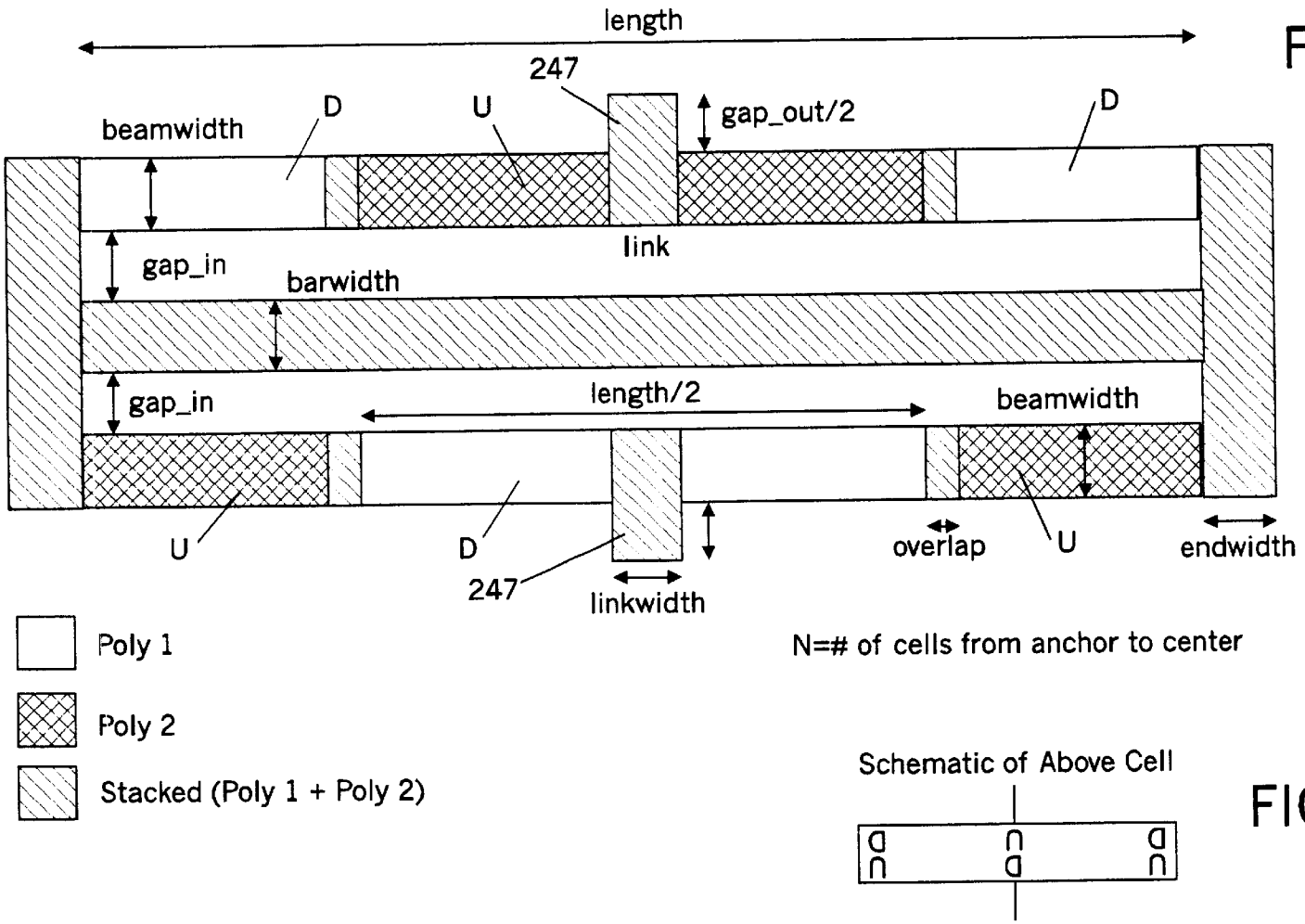
FIGS. 9(*a*) and 9(*b*) respectively provide a plan view of an integrated U-D-U and D-U-D out-of-plane thermally actuated structure embodiment and a schematic representation thereof, according to the present invention.

While the U-D-U and D-U-D structures can accordingly be used to create thermally actuated structures capable of moving in a third dimension, these individual structures are somewhat limited in this regard. For example, the U-D-U structure is capable of moving further away from the underlying substrate, while the D-U-D structure can move further toward the underlying substrate, in response to thermal actuation. The U-D-U and D-U-D structures are scalable and may be arrayed to provide relatively large amounts of displacement. Accordingly, one embodiment of the present invention provides a thermally actuated structure that integrates the capabilities of the thermally actuated U-D-U and D-U-D structures. As shown in FIG. 9(*a*), a thermally actuated microelectromechanical structure embodiment integrating the U-D-U and D-U-D structures is provided by the present invention. This embodiment comprises an underlying microelectronic substrate defining a generally planar surface, a first arched beam, a second arched beam, an interconnecting bar, and one anchor. The substrate, arched beams, and anchors are as described previously, while the interconnecting bar is preferably but not necessarily formed of the same material and concurrently with the arched beams. As described previously with the crossbeam, the interconnecting bar can be formed from a material having a lower thermal coefficient of expansion than the first and second arched beams. As such, the thermally actuated structure will provide predictable displacement as a function of temperature and can thereby be used as a thermostat or temperature sensor. As before, the U-D-U and D-U-D embodiment requires an expansion gradient between the interconnecting bar and the first and second arched beams in response to thermal actuation. As before, in operation the interconnecting bar preferably expands differently than, such as more or less than, the arched beams when thermal actuation is applied to the first and second arched beams. As with the previous example, this may be achieved by applying thermal actuation differently to, or selecting different materials for, the interconnecting bar and the first and second arched beams.

The first arched beam and second arched beam each comprise a medial portion and two end portions. For example, one arched beam could be one of the arched beams with a U-D-U structure, while the other could be one of the arched beams with a D-U-D structure. In the absence of thermal actuation, the first arched beam is arched such that the medial portion thereof is spaced further from the microelectronic substrate than the two opposed end portions. As shown in the Figure, for instance, the first arched beam is represented by the D-U-D beam structure. In contrast, in the absence of thermal actuation, the second arched beam is arched such that the medial portion is spaced closer to the microelectronic substrate than the two opposed end portions. For example, as shown, the second arched beam is represented by a U-D-U beam structure. Further, the interconnecting bar operably interconnects the end portions of the first and second arched beams. For example, the interconnecting bar could be generally I-shaped as shown, although many other shapes are possible. As shown in FIG. 9(*a*), link member, such as 247, may be provided at any arched beam to permit the U-D-U and D-U-D structures to be interconnected to other structures as necessary. At least one anchor is affixed to the substrate and also connected to at least one of the first arched beam, the second arched beam, and the interconnecting bar depending upon the application. Typically, however, the anchor is connected to a medial portion of one of the arched beams as described above. When selective thermal actuation is applied to the thermally actuated microelectromechanical structure of this embodiment, the actuated arched beams further arch so as to alter the separation of the interconnecting bar from the generally planar surface defined by the underlying microelectronic substrate.

Figure 10:
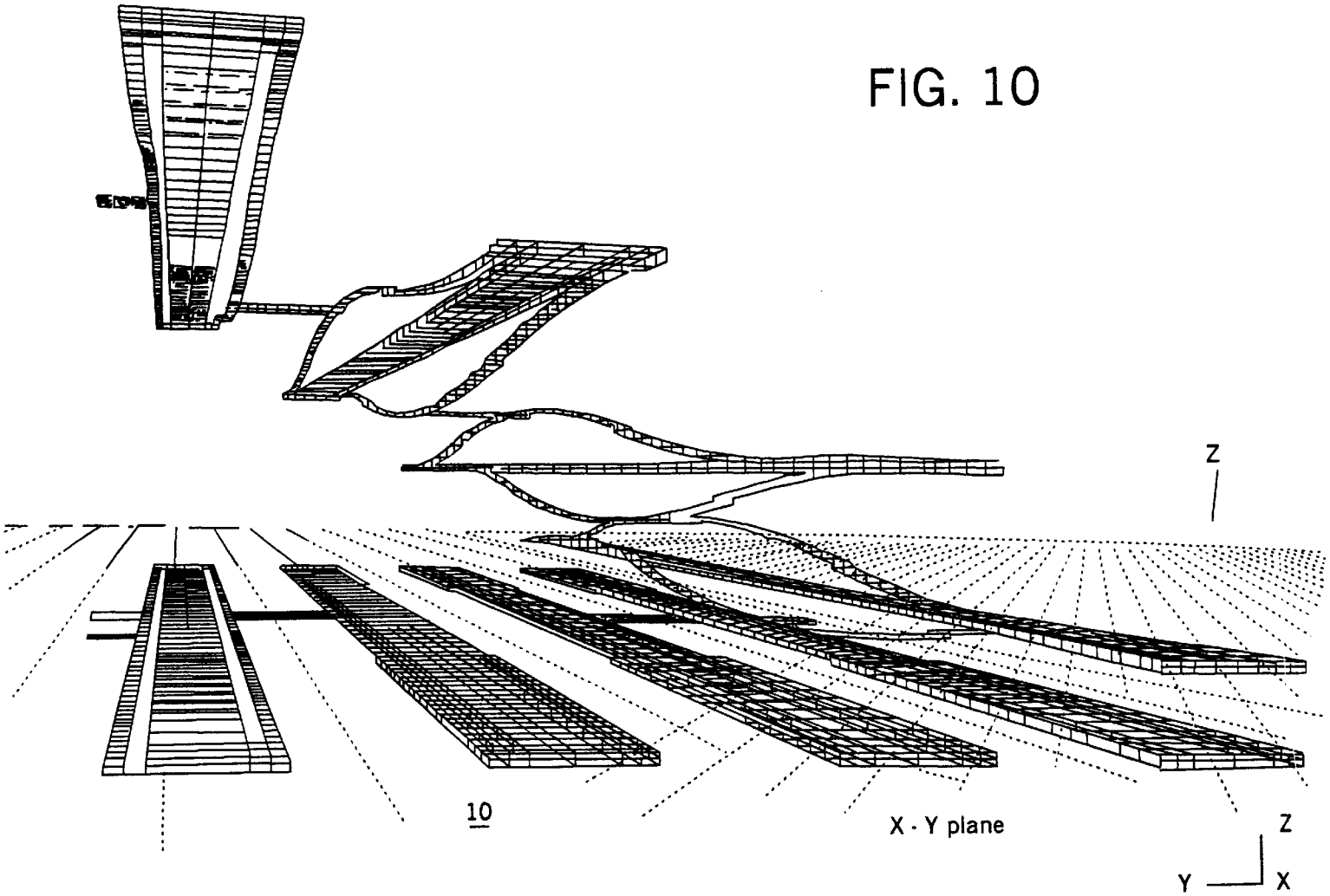
FIG. 10 provides a perspective view of an integrated U-D-U and D-U-D out-of-plane thermally actuated array embodiment, according to the present invention.

Accordingly, thermally actuating the first beam, that is, the D-U-D beam structure, further separates the medial portion from the generally planar surface, so as to correspondingly further separate or lift the interconnecting bar therefrom. Similarly, thermally actuating the second beam, that is, the U-D-U beam structure, reduces the separation of the medial portion from the generally planar surface, so as to correspondingly reduce the separation of the interconnecting bar therefrom. Thermally actuating both the first and second beams further arches the D-U-D and U-D-U beam structures, so as to cause the thermally actuated microelectromechanical structure of this embodiment to assume a generally teardrop-like shape. When fully actuated, the separation of the medial portion of the first beam, such as the U portion of the D-U-D structure, assumes a maximum separation from the generally planar surface, corresponding to the top of the teardrop-like shape. Examples of the thermally actuated microelectromechanical structure of this embodiment, in both the flat non-actuated and fully thermally actuated teardrop-like shapes are shown in FIG. 10, in which an array of interconnected thermally actuated structures are depicted. In addition, for purposes of illustration, a cell composed of a U-D-U beam, a D-U-D beam, and the interconnecting bar is represented schematically as shown in FIG. 9(*b*).

While fully applying thermal actuation to the integrated U-D-U and D-U-D thermally actuated microelectromechanical structure maximizes displacement in the third dimension, the total amount of displacement is limited by the size of the structure. Accordingly, the amount of displacement could be further increased by advantageously combining these thermally actuated microelectromechanical structures within an array. The present invention therefore provides a thermally actuated microelectromechanical array comprising a microelectronic substrate defining a generally planar surface and at least one anchor affixed thereto, as before. In addition, the thermally actuated array comprises a plurality of thermally actuated cells, each comprising the integrated U-D-U and D-U-D thermally actuated microelectromechanical structures as described above. At least one of the thermally actuated microelectromechanical cells is connected to, and extends from, at least one anchor, that is typically connected to a medial portion of one of the arched beams. Preferably, adjacent cells are interconnected through the respective medial portions of the arched beams. For example, the medial portions of two U-D-U beams, the medial portions of two D-U-D beams, or the medial portions of a U-D-U beam and a D-U-D beam, can be interconnected between adjacent thermally actuated cells. As shown in FIG. 9(*a*), the thermally actuated array of this embodiment can be formed by interconnecting adjacent thermally actuated cells through a link member 247 that extends from the medial portions of U-D-U and/or D-U-D beams within a thermally actuated cell.

In one advantageous embodiment, any thermally actuated microelectromechanical array described herein capable of motion in the third dimension can further comprise a platform, operably connected between adjacent thermally actuated cells. For example, the black disks shown within the thermally actuated arrays in FIGS. 11, 12, and 13 could represent the platform 250. The platform is mounted to and supported by the array, such as upon an interconnecting member, so that the separation from the underlying microelectronic substrate, or the generally planar surface defined thereby, may be altered in response to selective thermal actuation of the corresponding cells or array. If a platform is provided, the platform or disk could be a point, a small dot, or a structure having any shape and area required by a given practical application. In addition, the platform could support or otherwise serve as a pointer. Further, in one advantageous embodiment, the platform comprises a lens. Although any sort of lens or shutter structure could be used, preferably the platform supports a fresnel lens. A lens platform is particularly useful with any structure capable of altering the separation from the underlying microelectronic substrate, such that the lens may accordingly be used to focus or direct a beam of electromagnetic energy. Most preferably, a lens platform could be provided as shown with the thermally actuated array embodiment shown in FIG. 12, since this pyramid-like structure is well suited for raising or lowering a lens with respect to the underlying substrate. Further, the platform used with any thermally actuated embodiment, could support or otherwise serve as a pop up mirror disposed to selectively intersect a beam of electromagnetic radiation in response to thermal actuation. As such, the mirror platform could be raised or lowered as needed to intercept focused electromagnetic energy.

One example of a thermally actuated microelectromechanical array capable of motion in the third dimension comprises a plurality of operably interconnected thermally actuated cells. The thermally actuated cells are connected through the interconnection of the medial portion of the first arched beam in one thermally actuated cell to the medial portion of the second arched beam of another adjacent thermally actuated cell. The separation of the interconnected medial portions from the generally planar surface defined by the microelectronic substrate can accordingly be altered in response to thermal actuation of at least one of the thermally actuated cells. As such, the adjacent cells are cascaded such that the displacement contributions of each cell in the third dimension are combined together. This embodiment is shown in FIG. 10, and resembles an extended triangular truss or staircase shape when fully thermally actuated.

Figure 11:
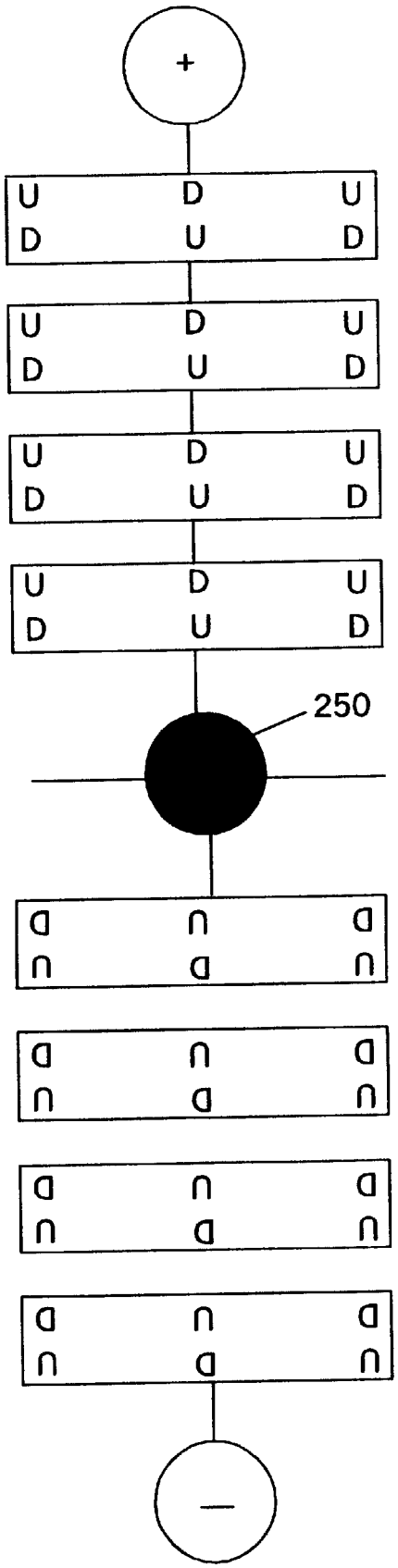
FIG. 11 provides a plan view of an integrated U-D-U and D-U-D out-of-plane thermally actuated array embodiment, according to the present invention.

A further related embodiment of the thermally actuated microelectromechanical array is shown in FIG. 11, in which a thermally actuated cell comprised of a D-U-D beam and an interconnected D-U-D beam are shown schematically. In this additional embodiment capable of third dimension displacement, at least two thermally actuated cells operably interconnected. The thermally actuated cells are connected through the medial portions of the first arched beams of two adjacent thermally actuated cells. As before, the separation of the interconnected medial portions from the generally planar surface defined by the microelectronic substrate can accordingly be altered in response to thermal actuation of at least one of the thermally actuated cells. Accordingly, the adjacent thermally actuated cells are interconnected so as to form a peak, similar to a triangular truss structure, when thermally actuated.

Figure 12:
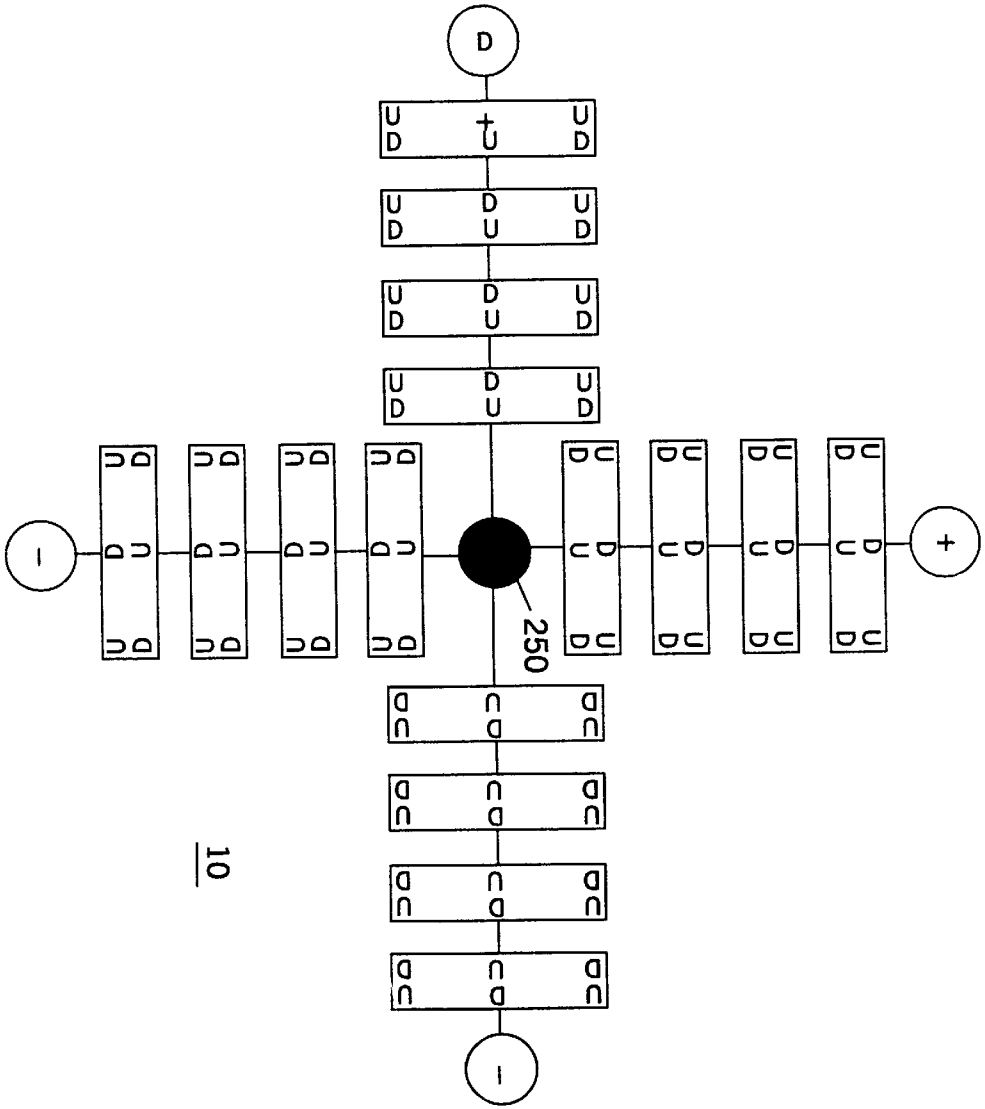
FIG. 12 provides a plan view of an integrated U-D-U and D-U-D out-of-plane thermally actuated array embodiment, according to the present invention.

One related embodiment of the thermally actuated microelectromechanical array capable of motion in the third dimension is shown in FIG. 12. When fully actuated, this structure resembles a pyramid, wherein the point of the pyramid may either be directed toward or away from the underlying substrate and its generally planar surface. In this embodiment, at least four thermally actuated cells are operably interconnected, as serve as the base of the pyramid. The thermally actuated cells are connected through the medial portions of the first arched beams of all four adjacent thermally actuated cells. As before, the separation of the interconnected medial portions from the generally planar surface defined by the microelectronic substrate can accordingly be altered in response to thermal actuation of at least one of the thermally actuated cells. Accordingly, the adjacent cells are interconnected so as to form a pyramid shape when thermally actuated. While many embodiments have been described herein that are capable of movement along one, two, or three dimensions or axes of movement, those skilled in the art will understand that many other structures capable of motion in one or more dimensions are encompassed within the spirit and scope of the present invention.

Hybrid Three Dimensional Displacement Array Structures

Figure 13:
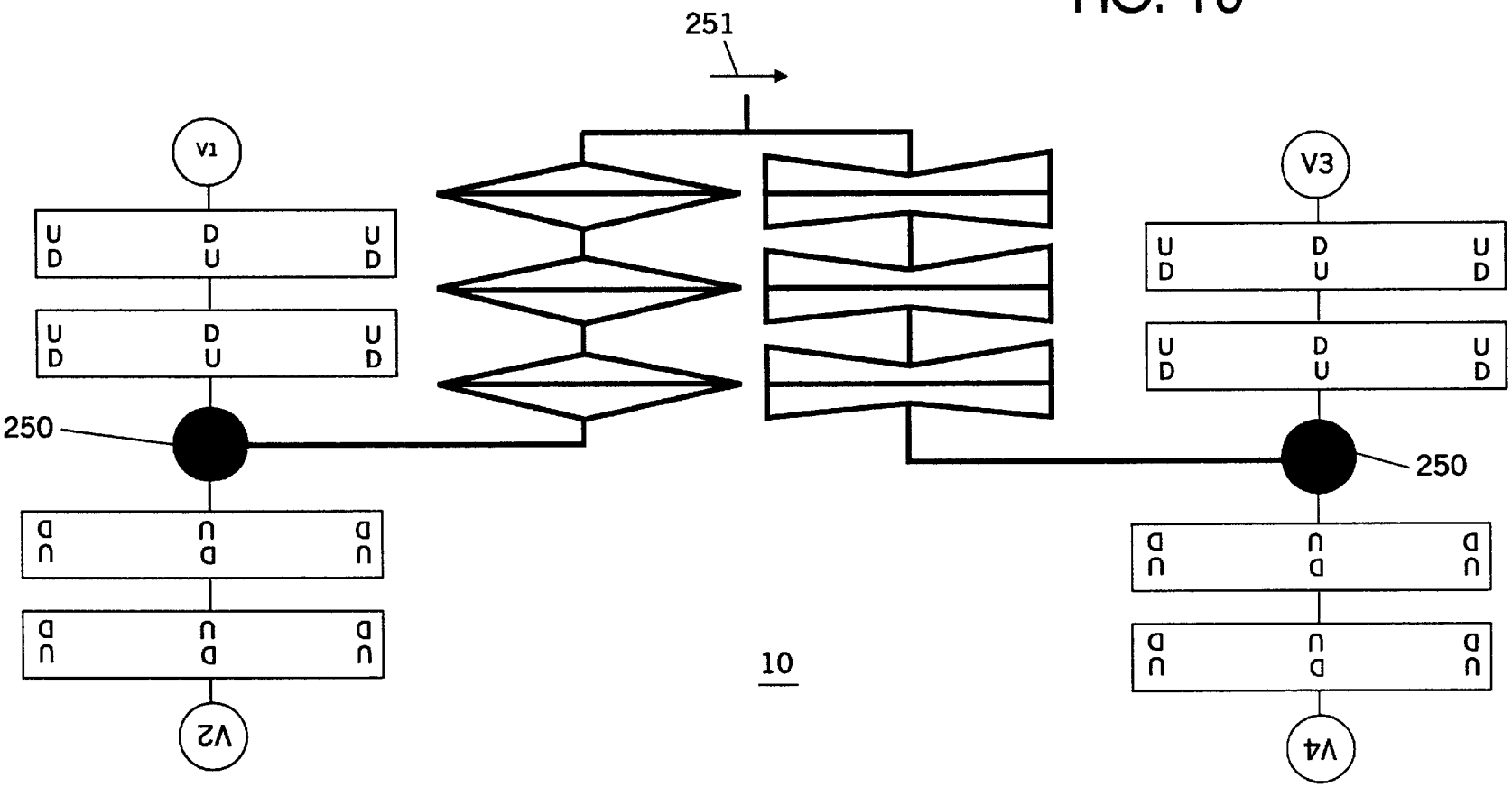
FIG. 13 provides a plan view of an integrated in-plane and out-of-plane thermally actuated array embodiment, according to the present invention.

As demonstrated, a wide variety of thermally actuated array configurations may be created by using the thermally actuated structures and cells described herein. As with the structures and cells comprising the array, the arrays are also scalable and can be configured to provide relatively large amounts of displacement. Previous embodiments have included arrays capable of movement within an X-Y plane and other arrays capable of movement along the Z axis. However, these arrays can be combined advantageously in numerous ways to create array embodiments capable of motion within both the X-Y plane and along the Z axis intersecting the X-Y plane. FIG. 13 shows but one example, among many, of this hybrid thermally actuated array embodiment. In essence, the array in this Figure comprises an interconnected combination of previously described arrays, such as an in-plane diamond shaped thermally actuated array interconnected to two out-of-plane integrated U-D-U/D-U-D arrays. The nodes labeled V1, V2, V3, and V4 represent points through which thermal actuation may be selectively applied to one or more component arrays. Thermally actuating the in-plane array causes the X-Y/Z hybrid thermally actuated array to move within the X-Y plane as desired. Thermally actuating one or more of the out-of-plane integrated U-D-U/D-U-D arrays correspondingly causes the hybrid thermally actuated array to move along the Z axis, perpendicular to the X-Y plane. Of course, thermal actuation may be applied simultaneously to both the X-Y and Z axis thermally actuated arrays, so to move in all three dimensions as desired. Those skilled in the art will appreciate that numerous permutations and combinations of thermally actuated arrays are possible, including other embodiments capable of X-Y and Z motion not described specifically herein. Further, according to the description above, these embodiments remain within the spirit and scope of the thermally actuated structures and arrays of the present invention as described herein.

Direct and Indirect Heating for Thermal Actuation

As mentioned above, thermal actuation provides the source of motion and displacement for the thermally actuated structures and arrays according to the present invention. Thermal actuation requires that structures to be moved, such as a thermal arched beam, be preferentially expanded in response to thermal actuation relative to adjacent structures and the microelectronic substrate. Typically, the structures to be moved should be maintained at a higher relative temperature. Alternatively, the structures to be moved can be constructed of a material that is more responsive to temperature changes. In addition, the thermal actuation should be provided selectively, such that thermal actuation can be applied to a selected structure, and can be activated and deactivated as required. Numerous techniques may be used to controllably provide thermal actuation. In this regard, the structures to be moved may be indirectly thermally actuated, such as by an external heater. Gasses or fluids of different temperatures can be used to heat or cool structures and thereby provide indirect thermal actuation. Alternatively, thermal actuation can be provided by direct heating, such as by passing electrical current through at least some portion of the thermal arched beams. Direct heating typically provides more efficient thermal actuation than indirect heating. Because the arched beams provide electrical resistance, heat can be generated directly therein as the current flows through the arched beams. Direct heating can provide more efficient thermal actuation because heat is generated closest to where it is used, such that heat loss can thus be minimized.

Other techniques can be used to increase the efficiency of thermal actuation, whether provided by direct or indirect heating. For example, indirect or external heaters can be positioned or disposed advantageously so as to mostly or totally heat only structures targeted for thermal actuation, such as close to a thermal arched beam. Further, as shown in FIGS. 3(*a*) and 3(*b*) and described previously in conjunction with the crossbeam, a heatsink or similar device may be used to keep structures not intended to be thermally actuated cooler than the structures to be thermally actuated. In addition, since considerable heat can be lost to the microelectronic substrate, preferably a trench or cavity is provided therein underneath the thermally actuated structures, such that an air gap thermally isolates the arched beams and reduces heating losses. While these techniques can be used to increase the efficiency of thermal actuation, inherent inefficiencies exist when applying heat indirectly to moving structures. For instance, an indirect heater must be positioned such that it can heat a moving structure all along the allowable path of movement. Accordingly, some heat will always be lost to the microelectronic substrate and ambient air when indirect heat based thermal actuation is used.

As described above, direct heating techniques can be used to reduce heat loss when thermally actuating a moving structure. Since heat is generated by conducting electrical current through an arched beam or other moving structure, unnecessary heat loss is avoided. Direct heating may be applied to the arched beams of an individual thermally actuated structure or cell, as well as to thermally actuated arrays. As shown in FIGS. 1(*a*) and 1(*c*), a thermal arched beam actuator can be designed to be thermally actuated directly by providing electrical current flow through at least part of the span of an arched beam, which serves to directly heat the arched beam. For example, FIG. 1(*a*) shows a current i flowing through the entire span of arched beam 35, which is constructed from a single material such that the electrical resistance is homogeneous throughout the span. In this example, the arched beams 35 are preferably formed of a single crystal material, such as silicon, or of a metallic material, such as nickel.

Differences in the cross sectional area of an arched beam or other structure can be used to provide different electrical resistances which, in turn, creates differential heating when current flows therethrough. For example, portions of an arched beam that have smaller cross sectional areas will have a higher electrical resistance and will therefore be heated more and move, i.e., expand, more than portions thereof having larger cross sectional areas. Optionally, the arched beams may be controllably doped to provide a predetermined amount of electrical resistance as required for heating purposes. If the arched beam is uniform, however, heat generated by the electric current flowing therein is generated homogeneously throughout the span of an arched beam. In instances in which current flows through the entire span of an arched beam and heats all portions of the arched beam, a significant portion of the heat generated therein is lost to the microelectronic substrate through the anchors located at the lateral end portions of the arched beam. As such, heating the medial portions of the arched beams contributes significantly more to the movement of the arched beam than heating the lateral end portions of the arched beams. Thus, heating the medial portions of an arched beam moves the arched beam more efficiently because there is better thermal isolation from the anchors.

Accordingly, the thermal arched beam actuator of one embodiment is designed such that more heat is generated in the medial portions of the arched beams than in the remaining end portions of the arched beams. FIG. 1(*c*) illustrates one example of this embodiment. As such, greater electrical resistance is provided by, and therefore more heat is focused upon those portions of the arched beams, i.e., the medial portions, that contribute more to the resulting movement of the arched beam so that heating loss in the lateral portions of the arched beams is largely avoided. In contrast to the embodiments shown in FIGS. 1(*a*) and 1(*b*), the arched beams in this embodiment are not constructed homogeneously.

As shown in FIG. 1(*c*), for example, at least a portion of the anchors and the lateral end portions of the arched beams can be provided with an electrically conductive path so that the medial portions of the arched beam have relatively greater electrical resistance. Preferably, the arched beam may be formed from a semiconductor material, such as silicon, and the doping level can be varied as needed to control the electrical resistance across the span of the arched beam, such that the medial portion has greater resistance than the end portions. Alternatively, a conductive material may be applied to at least part of the span of the arched beams, such as the lateral end portions of the arched beams. Conductive materials, such as metal and, more particularly, such as gold or aluminum, which are more electrically conductive than the semiconductor material preferably forming the arched beams may be used. When an electrical current i flows through the span of an arched beam having medial and lateral end portions as described, significantly greater electrical heat is generated in the medial portions having greater electrical resistance. In any case, the medial portions of the arched beams will be preferentially heated so as to cause at least the medial portions of the arched beams to further arch without unnecessarily heating the lower resistance lateral end portions of the arched beams. Heat loss through the anchors is thus largely avoided. Less heat energy is wasted on the lateral end portions of the arched beams, so that more efficient direct heating is provided.

Direct heating may also be applied advantageously to the in-plane, out of plane, and hybrid thermally actuated structures and arrays provided by the present invention. For instance, as shown in FIG. 2(*a*), a pair of contact pads 105 and 110 can be disposed upon the anchor 100 and connected to a continuous electrically conductive path that follows at least a portion of the pair of thermal arched beams of each of the three diamond shaped thermally actuated structures/cells shown therein. When a source of electrical energy 260 is operably connected to the respective contact pads, such as by applying a voltage differential therebetween, an electrical current i can flow through the electrically conductive path so as to selectively energize and thermally actuate at least one arched beam therein. While this Figure shows an electrically conductive path disposed around the outer perimeter of three diamond shaped thermally actuated structures, those skilled in the art will understand that an electrically conductive path may be disposed around the perimeter of a single diamond shaped structure or cell. For example, a continuous circuit loop could be created between contact pads 105 and 100 through thermal arched beams 120 and 115, such that only the diamond shaped cell proximate the contact pads could be electrically heated.

Figure 16:
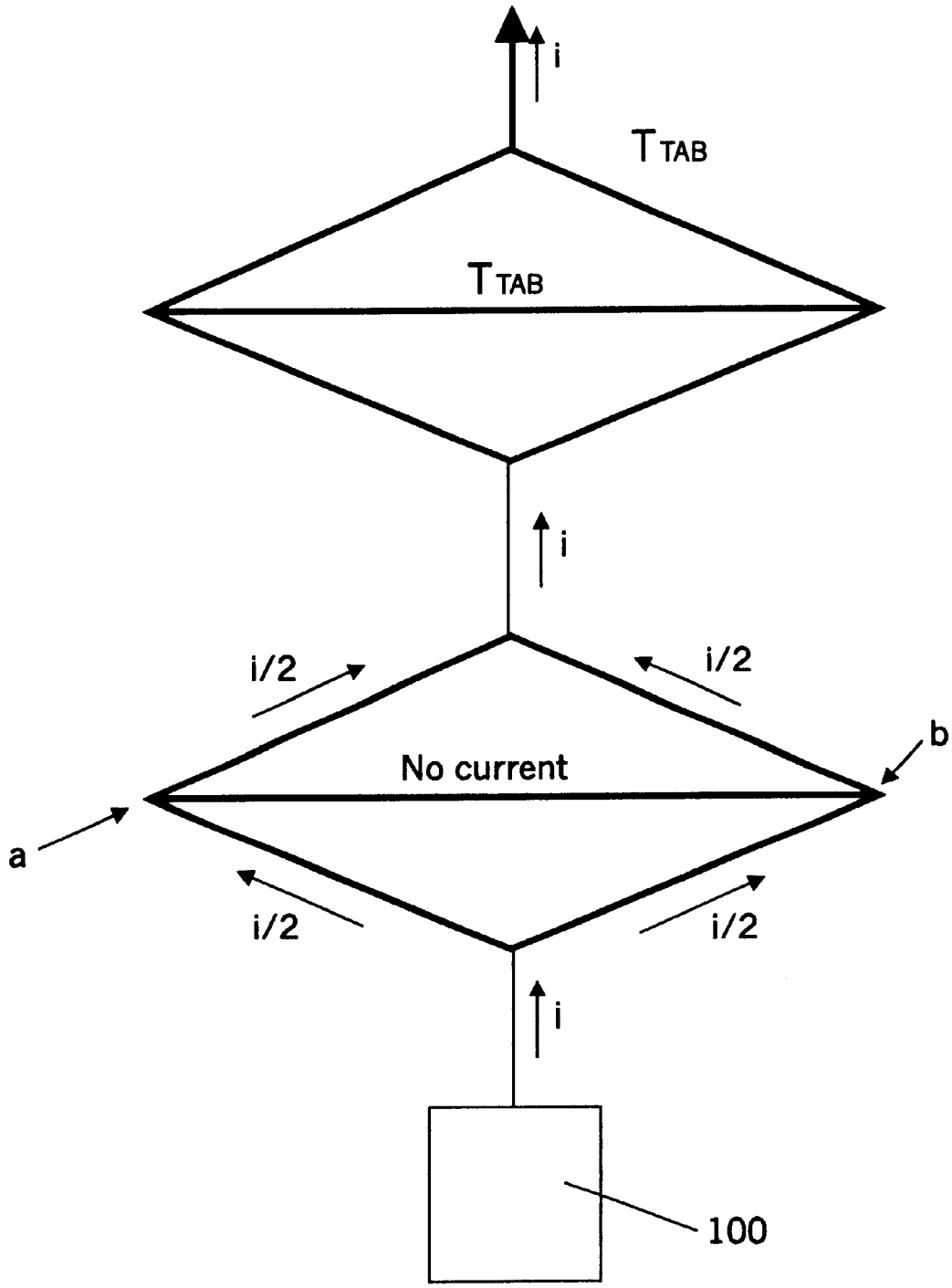
FIG. 16 provides a plan view of current flow through a crossbeam in a thermally actuated array, according to the present invention.

As before, the electrically conductive path is disposed along the thermal arched beams, either by selective doping or applying a conductor to the arched beams. Preferably, the conductive path has a lower electrical resistance than the remainder of the thermal arched beam, but sufficient electrical resistance to generate heat as required along the span of the arched beam. Preferably, the crossbeams are not coated with the conductive material to force the majority of the current to flow from contact pad to contact pad through the arched beams, as described below. If the crossbeams are also electrically conductive, only minimum leakage currents will flow therethrough because the difference in voltage between the ends of the crossbeam disposed parallel to the circuit path will be minimal at best. For instance, as shown in FIG. 16, the electrical current i flowing from anchor 100 into the first diamond shaped structure splits substantially equally into two i/2 portions flowing through the conductive paths along the arched beams. Accordingly, little if any current will flow through the crossbeam because there is no voltage difference to provide current flow through the crossbeam. For example, if there is no potential difference between nodes a and b, then of course no electrical current will flow through crossbeam 125.

In operation, the diamond shaped thermally actuated array is thermally actuated by passing current through the arched beams, such as by providing a source of electrical energy 260 to provide current flow between the contact pads 105 and 110 as shown in FIG. 2. As the current i flows along the path of conductive material, heat is generated accordingly along the thermal arched beam. Heat is conducted from the path of conductive material into the remainder of the arched beams, thereby heating the arched beams. As such, each beam arches further, thus expanding each diamond shaped cell as each pair of beams separate further in response to thermal actuation. Collectively, the expansion of each pair of beams causes the thermally actuated diamond shaped array to move in preselected direction 51, thereby moving a platform 135 accordingly. When current is removed, the pair of arched beams within each diamond shaped cell reassume the non-actuated position.

By analogy, the above discussion applies equally to individual or arrayed bowtie shaped thermally actuated structures or cells. For instance, direct heating details for the bowtie configurations are similarly shown in FIG. 2(*c*), wherein an electrically conductive path is provided through contact pads 105 and 110, and around the perimeter defined by the three bowtie shaped thermally actuated cells. In operation, the bowtie shaped array is distinguished because the cells compress instead of expanding when the constituent thermal arched beams are thermally actuated. Collectively, the compression or contraction of each pair of beams causes the bowtie shaped array to move in preselected direction 52, thereby moving platform 160 accordingly.

The thermally actuated actuator structures of FIG. 4(*a*) and 4(*b*) can be directly heated although these structures only include one arched beam. While direct heating will be described for the D-shaped actuator of FIG. 4(*a*), this discussion applies equally to the actuator shown in FIG. 4(*b*). For these actuator structures, the crossbeam may be used advantageously for direct heating purposes. As shown in FIG. 4(*a*), an electrical current i may be introduced through contact pads, such as "+" and "−" for instance, disposed at an anchor 100. Preferably, the crossbeam 262 is electrically conductive, and has a lower electrical resistance than the arched beam 264. Accordingly, the current will split equally and flow through the respective halves of the arched beam, as shown by the two i/2 arrows. Current flow will then be combined by flowing through interconnecting member 268, into the next crossbeam. The current will divide anew when flowing through the next arched beam. Electrical current will flow in this manner through successive crossbeams and arched beams in a circuit loop, repeating the above current division and combination process until current i exits the complimentary contact pad. Since the crossbeam preferably has a lower electrical resistance, the arched beams are electrically heated and thermally actuated to a greater extent. If the crossbeam is formed of the same material as the arched beam, differences in cross sectional areas can be used to distribute electrical resistance between the crossbeam and arched beam as required for heating purposes. Further, metal deposition or controlled doping can also be used to tailor the electrical resistance. The D-shaped actuator structure can also be directly heated in a parallel array configuration analogous to that shown in FIGS. 14 and 15 corresponding to the diamond and bowtie arrays.

Figure 14:
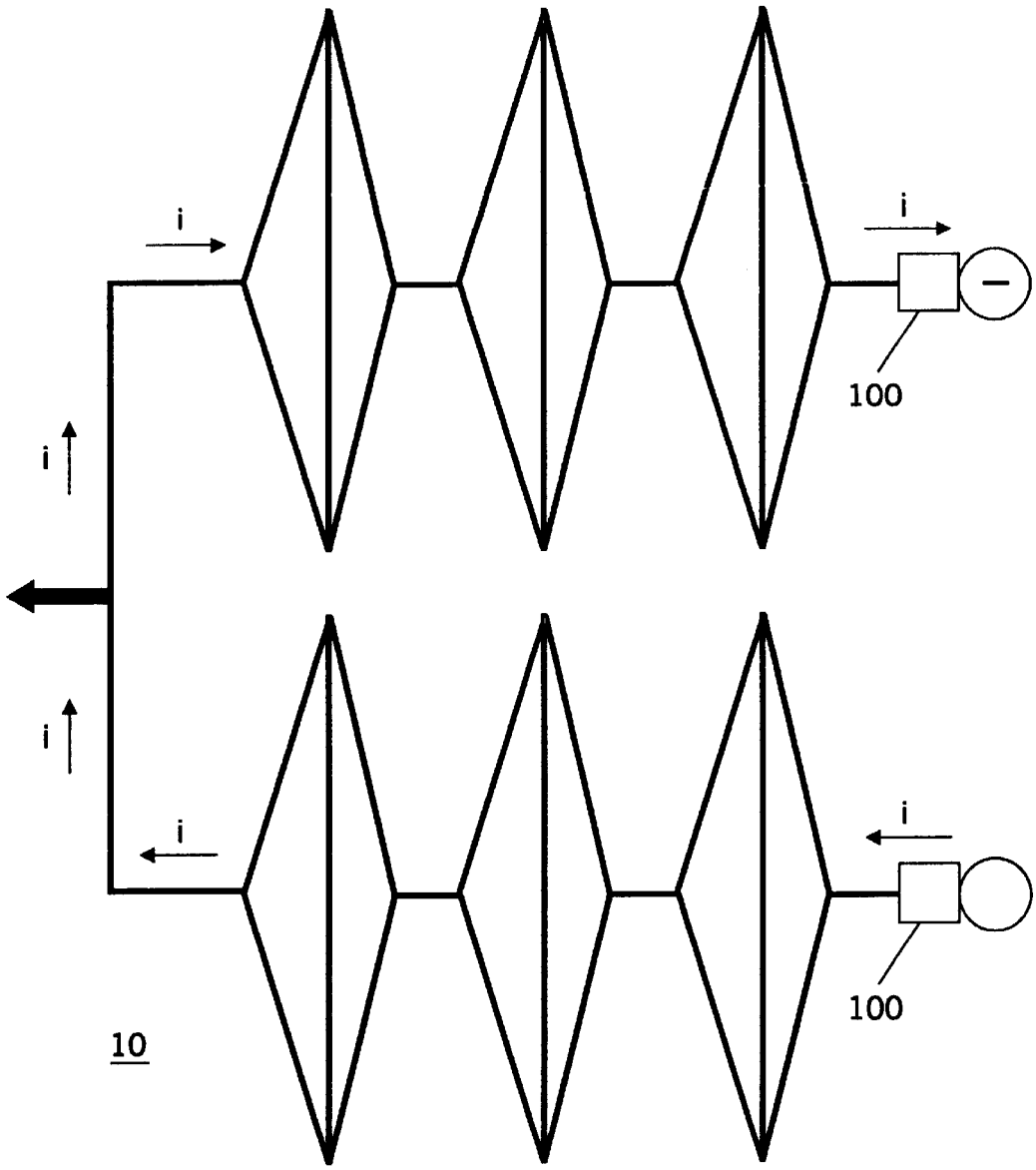
FIG. 14 provides a plan view of a direct heating embodiment for one in-plane thermally actuated array, according to the present invention.
Figure 15:
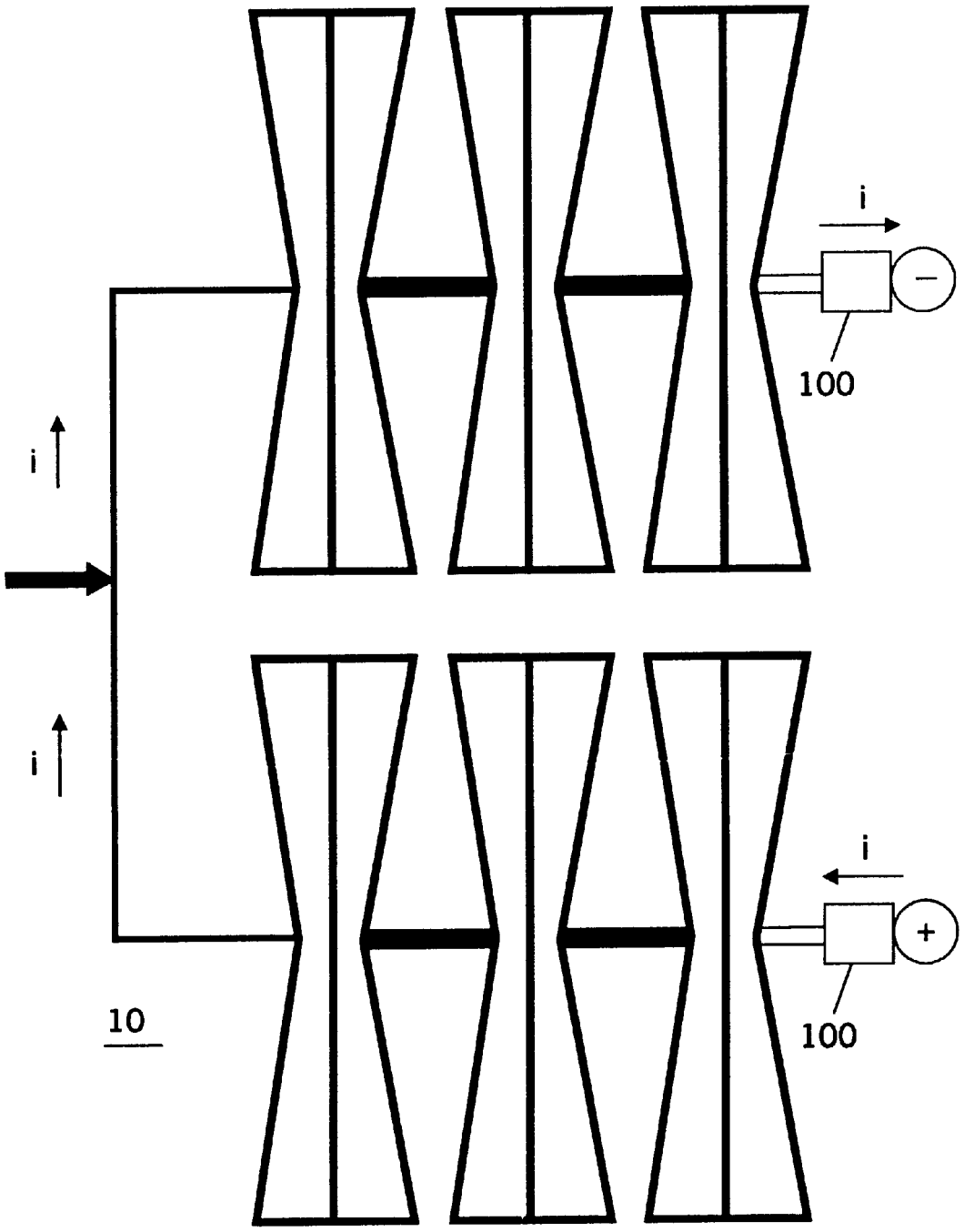
FIG. 15 provides a plan view of a direct heating embodiment for another in-plane thermally actuated array, according to the present invention.

The in-plane diamond and bowtie shaped thermally actuated arrays can be directly heated by using other techniques. For example, alternative direct heating arrangements are shown in FIGS. 14 and 15 for the diamond shaped arrays and bowtie shaped arrays respectively. In each Figure, contact pads denoted as "+" and "−" are provided through anchors 100, although direct heating occurs equally without regard to the polarity of current flowing therebetween. For these embodiments, current flows from one contact pad, through a first array and a second serially connected array, and back around to the other contact pad in a continuous loop. In essence, a circuit loop is created through serially interconnected thermally actuated arrays. While this arrangement can provide greater force given the mirrored thermally actuated arrays, significantly larger amounts of area are required to implement this arrangement. While the direct heating arrangements shown in FIGS. 2(*a*) and 2(*c*) respectively provide less force, they are preferred because they consume much less substrate area than the arrangements in FIGS. 14 and 15.

In addition, direct heating may be used to thermally actuate the out-of plane structures, such as the U-D-U and D-U-D thermally actuated structures shown in FIGS. 7 through 12. Further, the aforementioned hybrid X-Y plane/Z axis thermally actuated arrays capable of three dimensional displacement can also be directly heated. For example, the hybrid arrays in FIG. 13 provide four nodes, V1–V4, through which thermal actuated may be applied. By controlling the voltages at the four nodes, one, several, or all component X-Y and Z arrays can be thermally actuated selectively. Thus, direct heating and/or control of which arrays are thermally actuated can be provided by this configuration. For example, if nodes V1 and V3 are set to voltage potential +V, and nodes V2 and V4 are set to −V volts, then arrow 251 would move in the Z dimension. If the nodes were setup such that V1 and V2 were at +v volts, and nodes V3 and V4 were at −V volts, then arrow 251 would move in both the Z and Y directions. Of course, many other array configurations and node voltage settings are possible within the scope of the present invention. The more complicated the thermally actuated array, the greater the efficiency and selective thermal actuation benefits of direct heating.

As described above, the MEMS thermally actuated structures and arrays are moveable in one, two, and/or three dimensions. In addition, significant amounts of movement and displacement are provided by the thermally actuated structures and arrays. As such, these thermally actuated MEMS structures can be employed in various applications that demand or prefer movement in these dimensions. For example, the aforementioned embodiments of the MEMS thermally actuated structures and arrays can be utilized in a wide variety of applications, such as in variable capacitors, inductors, and resistors, switches and relays, optical switching and interconnection arrays, electromagnetic shutters, valves, thermostats, temperature sensors, and the like.

In the drawings and specification, there have been disclosed typical preferred embodiments of the present invention and, although specific terms are employed, they are used only in a generic and descriptive sense only and not for purposes of limiting the scope of the present invention as set forth in the following claims.

That which is claimed:

1. A thermally actuated microelectromechanical structure, comprising:

a microelectronic substrate;

at least one anchor affixed to said microelectronic substrate; and a pair of arched beams, each arched beam having a medial portion and first and second end portions, wherein the first end portions of said pair of arched beams are operably interconnected, wherein the second end portion of said pair of arched beams are operably interconnected, and wherein one arched beam within said pair is connected to said at least one anchor, such that said pair of arched beams extends from said at least one anchor in a cantilever configuration overlying said microelectronic substrate;

wherein thermal actuation further arches said pair of arched beams causing said pair of arched beams to correspondingly move along a predetermined path with respect to said microelectronic substrate.

2. A microelectromechanical structure according to claim 1, further comprising a crossbeam disposed between said pair of arched beams so as to operably connect the first and second ends of said pair of arched beams.

3. A microelectromechanical structure according to claim 2, wherein the crossbeam is adapted to be heated less than said pair of arched beams when the microelectromechanical structure is thermally actuated.

4. A microelectromechanical structure according to claim 1, wherein said pair of arched beams are arranged such that concave portions of said pair of arched beams face one another, thereby defining a generally diamond shaped structure adapted to expand along the predetermined path in response to thermal actuation thereof.

5. A microelectromechanical structure according to claim 1, wherein said pair of arched beams are arranged such that convex portions of said pair of arched beams face one another, thereby defining a generally bowtie shaped structure adapted to compress along the predetermined path in response to thermal actuation thereof.

6. A microelectromechanical structure according to claim 1, further comprising:

a guide surface; and at least one roller, disposed between said pair of arched beams and said guide surface, such that said pair of arched beams are guided along the predetermined path by movement of said at least one roller along said guide surface, in response to the selective thermal actuation thereof.

7. A microelectromechanical structure according to claim 1, further comprising a guide surface, said guide surface defining a track extending lengthwise therealong to define the predetermined path of movement of said pair of arched beams, wherein said pair of arched beams are received by the track and thereby guided along the predetermined path of movement, in response to the selective thermal actuation thereof.

8. A microelectromechanical structure according to claim 1, further comprising a heater, disposed so as to selectively apply thermal actuation to said pair of arched beams.

9. A microelectromechanical structure according to claim 8, wherein said heater comprises a source of electrical energy and an electrically conductive path, wherein said electrically conductive path is disposed along said pair of arched beams, and wherein said source of electrical energy is operably connected to said electrically conductive path so as to selectively heat said pair of arched beams.

10. A microelectromechanical structure according to claim 1, wherein said pair of arched beams is adapted to move along a predetermined path selected from the group consisting of a one dimensional path of movement and a two dimensional path of movement.

11. A thermally actuated microelectromechanical structure, comprising:

a microelectronic substrate;

at least one anchor affixed to said microelectronic substrate;

an arched beam, said arched beam having a medial portion and two end portions; and a crossbeam, operably connecting the opposed end portions of said arched beam such that the separation of the medial portion from said crossbeam differs from the separation of the two end portions from said crossbeam, wherein said at least one anchor is operably connected to at least one of said arched beam and said crossbeam such that the arched beam and said crossbeam overlie said microelectronic substrate in a cantilever configuration, and wherein thermal actuation further arches the medial portion so as to alter the separation thereof from the crossbeam and thereby cause movement along a predetermined path with respect to said microelectronic substrate.

12. A microelectromechanical structure according to claim 11, wherein said crossbeam is adapted to be heated less than said arched beam when said microelectromechanical structure is thermally actuated.

13. A microelectromechanical structure according to claim 11, wherein said crossbeam and said arched beam are formed from materials having different thermal coefficients of expansion.

14. A microelectromechanical structure according to claim 11, wherein said crossbeam has a larger cross sectional area than said arched beam.

15. A microelectromechanical structure according to claim 11, further comprising a heater, disposed so as to selectively apply thermal actuation to at least one of said arched beam and said crossbeam.

16. A microelectromechanical structure according to claim 11, wherein the separation of the medial portion from said crossbeam is greater than the separation of the two end portions therefrom, such that the medial portion arches further away from said crossbeam in response to thermal actuation.

17. A microelectromechanical structure according to claim 11, wherein the separation of the medial portion from said crossbeam is less than the separation of the two end portions therefrom, such that the medial portion arches further toward said crossbeam in response to thermal actuation.

18. A microelectromechanical structure according to claim 11, wherein said arched beams and said crossbeams comprise a thermally actuated cell, said microelectromechanical structure further comprising a plurality of thermally actuated cells, each thermally actuated cell interconnected to adjacent thermally actuated cells such that said plurality of thermally actuated cells cooperatively move along the predetermined path in response to thermal actuation of at least one cell.

19. A thermally actuated microelectromechanical array, comprising:

a microelectronic substrate;

at least one anchor affixed to said microelectronic substrate; and a plurality of thermally actuated microelectromechanical cells, wherein each thermally actuated microelectromechanical cell comprises a pair of arched beams operably connected at opposite ends thereof, wherein a first thermally actuated microelectromechanical cell is connected to and extends from said at least one anchor, and wherein the remainder of the thermally actuated microelectromechanical cells are operably connected to the first thermally actuated microelectromechanical cell such that the plurality of microelectromechanical cells thereby extend from said at least one anchor in a cantilever configuration overlying said microelectronic substrate, and wherein selective thermal actuation further arches the pair of arched beams of at least one of the thermally actuated microelectromechanical cells, thereby causing said plurality of thermally actuated microelectromechanical cells to correspondingly move along a predetermined path with respect to said microelectronic substrate.

20. A thermally actuated microelectromechanical structure array according to claim 19, wherein each thermally actuated microelectromechanical structure further comprises a crossbeam, disposed between each said pair of arched beams so as to operably connect opposite ends of each said pair of arched beams.

21. A thermally actuated microelectromechanical structure array according to claim 19, wherein the crossbeam is adapted to be heated less than said pair of arched beams when thermal actuation is applied to the respective thermally actuated microelectromechanical cells.

22. A thermally actuated microelectromechanical structure array according to claim 19, wherein the first thermally actuated microelectromechanical cell is connected to said at least one anchor through a medial portion of a respective one of said pair of arched beams within the first thermally actuated cell.

23. A thermally actuated microelectromechanical structure array according to claim 19, wherein said pair of arched beams of at least one thermally actuated microelectromechanical cell are arranged such that concave portions of said pair of arched beams face one another, thereby defining a generally diamond shaped structure adapted to expand along the predetermined path in response to thermal actuation thereof.

24. A thermally actuated microelectromechanical structure array according to claim 19, wherein said pair of arched beams of at least one thermally actuated microelectromechanical cell are arranged such that convex portions of said pair of arched beams face one another, thereby defining a generally bowtie shaped structure adapted to compress along the predetermined path in response to thermal actuation thereof.

25. A thermally actuated microelectromechanical structure array according to claim 19, further comprising:

a rail surface; and at least one roller, disposed between each said pair of arched beams and said rail surface, such that each corresponding thermally actuated microelectromechanical cell is guided along the predetermined path by movement of said at least one roller along said rail surface, in response to the selective thermal actuation thereof.

26. A thermally actuated microelectromechanical structure array according to claim 19, further comprising a heater, disposed so as to selectively apply thermal actuation to at least one of said plurality thermally actuated microelectromechanical cells.

27. A thermally actuated microelectromechanical structure array according to claim 19, wherein said heater comprises a source of electrical energy and an electrically conductive path, wherein said electrically conductive path is disposed along each said pair of arched beams, and wherein said source of electrical energy is operably connected to said electrically conductive path so as to selectively heat each said pair of arched beams.

28. A thermally actuated microelectromechanical structure array according to claim 19, wherein said plurality thermally actuated microelectromechanical cells are adapted to move along a predetermined path selected from the group consisting of a one dimensional path of movement and a two dimensional path of movement.

29. A thermally actuated microelectromechanical array according to claim 19, further comprising a plurality of Z-axis thermally actuated cells, wherein said microelectronic substrate defines a generally planar X-Y plane, and wherein each Z-axis thermally actuated cell comprises:

a first arched beam, said first arched beam having a medial portion and two end portions, wherein said first arched beam is arched in the absence of thermal actuation such that the medial portion is spaced further from said X-Y plane than the two opposed end portions;

a second arched beam, said second arched beam having a medial portion and two end portions, wherein said second arched beam is arched in the absence of thermal actuation such that the medial portion is spaced closer to said X-Y plane than the two opposed end portions; and an interconnecting bar, operably interconnecting the end portions of said first and said second arched beams; said interconnecting bar further adapted to operably interconnect adjacent thermally actuated cells, wherein said thermally actuated microelectromechanical cells are operably connected to said plurality of Z-axis thermally actuated cells, such that selective thermal actuation of said thermally actuated microelectromechanical cells further arches the arched beams therein so as to move the operably connected Z-axis thermally actuated cells and thermally actuated microelectromechanical cells within a plane parallel to the X-Y plane, and such that selective thermal actuation of said Z-axis thermally actuated cells further arches the arched beams therein so as to move the operably connected thermally actuated microelectromechanical cells and said Z-axis thermally actuated cells perpendicular to the X-Y plane along a Z-axis.

30. A thermally actuated microelectromechanical array according to claim 29, further comprising a platform operably connected to said thermally actuated microelectromechanical array and said plurality of Z-axis thermally actuated cells, such that the separation of the platform from the generally planar surface of the microelectronic substrate is altered in response to selective thermal actuation.

31. A thermally actuated microelectromechanical structure, comprising:

a microelectronic substrate, defining a generally planar surface;

at least one anchor affixed to said microelectronic substrate; and at least one arched beam, said at least one arched beam connected to said at least one anchor and having a medial portion and two end portions that are positionally constrained with respect to one another such that the distance between the two end portions is fixed, said at least one arched beam being arched in a nonparallel direction with respect to the generally planar surface of said substrate in the absence of thermal actuation;

wherein selective thermal actuation of said at least one arched beam causes said at least one arched beam to further arch in the nonparallel direction with respect to the generally planar surface of said substrate such that the medial portion arches to a greater degree than the two opposed end portions due to the positional constraint therebetween, thereby further altering the separation of the medial portion from the generally planar surface of said microelectronic substrate.

32. A thermally actuated microelectromechanical structure according to claim 31, wherein said at least one arched beam is arched in a direction away from the generally planar surface of said microelectronic substrate, such that medial portion of said at least one arched beam arches further away from the generally planar surface in response to selective thermal actuation thereof.

33. A thermally actuated microelectromechanical structure according to claim 31 wherein said at least one arched beam is arched in a direction toward the generally planar surface of said microelectronic substrate, such that medial portion of said at least one arched beam arches further toward the generally planar surface in response to selective thermal actuation thereof.

34. A thermally actuated microelectromechanical structure, comprising:

a microelectronic substrate, defining a generally planar surface;

at least one anchor affixed to said microelectronic substrate; and at least one arched beam, said at least one arched beam connected to said at least one anchor and having a medial portion and two end portions, said at least one arched beam being arched in a nonparallel direction with respect to the generally planar surface of said substrate in the absence of thermal actuation;

wherein selective thermal actuation of said at least one arched beam causes said at least one arched beam to further arch in the nonparallel direction with respect to the generally planar surface of said substrate such that the medial portion arches to a greater degree than the two opposed end portions, thereby further altering the separation of the medial portion from the generally planar surface of said microelectronic substrate; and wherein said at least one arched beam comprises a first layer and a second layer, the second layer at least partially overlying the first layer, and wherein the medial portion and the two end portions thereof are disposed in different layers.

35. A thermally actuated microelectromechanical structure according to claim 31, wherein the medial portion of said at least one arched beam smoothly arches between the two opposed end portions.

36. A thermally actuated microelectromechanical structure array according to claim 31, further comprising a heater, disposed so as to selectively apply thermal actuation to said at least one arched beam.

37. A thermally actuated microelectromechanical structure array according to claim 31, wherein said heater comprises a source of electrical energy and an electrically conductive path, wherein said electrically conductive path is disposed along each said at least one arched beam, and wherein said source of electrical energy is operably connected to said electrically conductive path so as to selectively energize each said at least one arched beam.

38. A thermally actuated microelectromechanical structure, comprising:

a microelectronic substrate, defining a generally planar surface;

a first arched beam, said first arched beam having a medial portion and two end portions, wherein said first arched beam is arched in the absence of thermal actuation such that the medial portion is spaced further from said substrate than the two opposed end portions;

a second arched beam, said second arched beam having a medial portion and two end portions, wherein said second arched beam is arched in the absence of thermal actuation such that the medial portion is spaced closer to said substrate than the two opposed end portions;

an interconnecting bar, operably interconnecting the end portions of said first and said second arched beams; and at least one anchor affixed to said microelectronic substrate, said at least one anchor affixed to at least one of said first arched beam, said second arched beam, and said interconnecting bar;

wherein selective thermal actuation of at least one arched beam further arches said at least one arched beam so as to alter the separation thereof from the generally planar surface of said microelectronic substrate.

39. A thermally actuated microelectromechanical structure array according to claim 38, further comprising a heater, disposed so as to selectively apply thermal actuation to at least a portion of said first arched beam and said second arched beam.

40. A thermally actuated microelectromechanical structure array according to claim 38, wherein said heater comprises a source of electrical energy and an electrically conductive path, wherein said electrically conductive path is disposed along said first arched beam and said second arched beam, and wherein said source of electrical energy is operably connected to said electrically conductive path so as to selectively heat said first and said second arched beams.

41. A thermally actuated microelectromechanical array, comprising:

a microelectronic substrate, defining a generally planar surface;

at least one anchor affixed to said microelectronic substrate; and a plurality of thermally actuated cells, wherein at least one of said thermally actuated cells is connected to and extends from said at least one anchor, each thermally actuated cell further comprising:

a first arched beam, said first arched beam having a medial portion and two end portions, wherein said first arched beam is arched in the absence of thermal actuation such that the medial portion is spaced further from said substrate than the two opposed end portions;

a second arched beam, said second arched beam having a medial portion and two end portions, wherein said second arched beam is arched in the absence of thermal actuation such that the medial portion is spaced closer to said substrate than the two opposed end portions; and an interconnecting bar, operably interconnecting the end portions of said first and said second arched beams; said interconnecting bar further adapted to operably interconnect adjacent thermally actuated cells.

42. A thermally actuated microelectromechanical structure array according to claim 41, further comprising a heater, disposed so as to selectively apply thermal actuation to at least a portion of said first arched beam and said second arched beam within each thermally actuated cell of the plurality.

43. A thermally actuated microelectromechanical structure array according to claim 41, wherein said heater comprises a source of electrical energy and an electrically conductive path, wherein said electrically conductive path is disposed along said first arched beam and said second arched beam within each thermally actuated cell of the plurality, wherein said source of electrical energy is operably connected to said electrically conductive path so as to selectively heat said first and said second arched beams.

44. A thermally actuated microelectromechanical array according to claim 41, wherein at least two adjacent thermally actuated cells are operably interconnected through the medial portion of the first arched beam of one thermally actuated cell and the medial portion of the second arched beam of another adjacent thermally actuated cell, such that the separation of the interconnected medial portions from the generally planar surface of said microelectronic substrate is altered in response to thermal actuation of at least one of said at least two thermally actuated cells.

45. A thermally actuated microelectromechanical array according to claim 41, wherein at least two adjacent thermally actuated cells are operably interconnected through the medial portion of the first arched beam of one thermally actuated cell and the medial portion of the first arched beam of another adjacent thermally actuated cell, such that the separation of the interconnected medial portions from the generally planar surface of said microelectronic substrate is altered in response to selective thermal actuation of at least one of said at least two thermally actuated cells.

46. A thermally actuated microelectromechanical array according to claim 45, further comprising a platform operably connected to the interconnected medial portions of said at least two adjacent thermally actuated cells, such that the separation of the platform from the generally planar surface of the microelectronic substrate is altered in response to selective thermal actuation.

47. A thermally actuated microelectromechanical array according to claim 41, wherein at least four adjacent thermally actuated cells are operably interconnected through the medial portions of the first arched beams of each of the four adjacent thermally actuated cells, such that the separation of the interconnected medial portions from the generally planar surface of said microelectronic substrate is altered in response to thermal actuation of at least one of said at least four thermally actuated cells.

48. A thermally actuated microelectromechanical array according to claim 47, further comprising a platform operably connected to the interconnected medial portions of said at least four adjacent thermally actuated cells, such that the separation of the interconnected medial portions from the generally planar surface of the microelectronic substrate is altered in response to selective thermal actuation.

* * * * *

UNITED STATES PATENT AND TRADEMARK OFFICE

CERTIFICATE OF CORRECTION

PATENT NO. : 6,218,762 B1
DATED : April 17, 2001
INVENTOR(S) : Edward A. Hill et al.

It is certified that error appears in the above-identified patent and that said Letters Patent is hereby corrected as shown below:

Title page,
Item [73] should read as follows: (73) Assignee: delete "MCNC, Research Triangle Park, NC (US)" and substitute -- JDS Uniphase Inc., Canada (CA) -- therefor.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*